US006582898B2

(12) United States Patent
Morita

(10) Patent No.: US 6,582,898 B2
(45) Date of Patent: Jun. 24, 2003

(54) SILVER SALT PHOTOTHERMOGRAPHIC MATERIAL

(75) Inventor: Kiyokazu Morita, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/017,609

(22) Filed: Dec. 7, 2001

(65) Prior Publication Data

US 2002/0119406 A1 Aug. 29, 2002

(30) Foreign Application Priority Data

Dec. 14, 2000 (JP) ..... 2000-380225

(51) Int. Cl.[7] ..... G03C 1/498

(52) U.S. Cl. ..... 430/619; 430/264; 430/350; 430/498; 430/531; 430/631

(58) Field of Search ..... 430/619, 631, 430/264, 498, 531, 350

(56) References Cited

U.S. PATENT DOCUMENTS

| | | | | |
|---|---|---|---|---|
| 5,599,647 | A | * | 2/1997 | Defieuw et al. |
| 6,150,084 | A | * | 11/2000 | Ito et al. ..... 430/619 |
| 6,203,972 | B1 | * | 3/2001 | Katoh et al. ..... 430/619 |
| 6,297,001 | B1 | * | 10/2001 | Takiguchi et al. ..... 430/619 |
| 6,344,313 | B1 | * | 2/2002 | Goto et al. ..... 430/619 |

* cited by examiner

*Primary Examiner*—Thorl Chea
(74) *Attorney, Agent, or Firm*—Muserlian, Lucas and Mercanti

(57) ABSTRACT

A silver salt photothermographic material is disclosed, comprising on a support a light-sensitive layer comprising an organic silver salt, light-sensitive silver halide grains, a reducing agent and a binder, wherein after the photothermographic material having been developed at a temperature of not less than 100° C. is subjected to exposure to light of an illumination intensity of 300 lux at 45° C. for 24 hrs., the rate of variation in fog density between before and after exposure is not more than 30%, based on the fog density of the photothermographic material before exposure.

13 Claims, No Drawings

SILVER SALT PHOTOTHERMOGRAPHIC MATERIAL

FIELD OF THE INVENTION

The present invention relates to silver salt photothermographic dry imaging materials and in particular to a silver salt photothermographic dry imaging material (hereinafter, also simply denoted as a photothermographic material) exhibiting high image quality and superior silver image lasting quality.

BACKGROUND OF THE INVENTION

In the field of graphic arts and medical treatment, there have been concerns in processing of photographic film with respect to effluent produced from wet-processing of image forming materials, and recently, reduction of the processing effluent is strongly demanded in terms of environmental protection and space saving. There has been desired a photothermographic dry imaging material for photographic use, capable of forming distinct black images exhibiting high sharpness, enabling efficient exposure by means of a laser imager or a laser image setter.

Known as such a technique are thermally developable silver salt photographic materials (which are the same as photothermographic materials, as described in the present invention) comprising on a support an organic silver salt, light-sensitive silver halide and a reducing agent, as described in D. Morgan and B. Shely, U.S. Pat. Nos. 3,152,904 and 3,487,075, and D. H. Klosterboer, "Thermally Processed Silver Systems" in IMAGING PROCESSES and MATERIALS, Neblette's Eighth Edition, edited by J. M. Sturge, V. Walworth, and A. Shepp (1969) page 279. The thermally developable silver salt photographic material provides a simply and environment-friendly system for users, without using any processing solution.

Such a photothermographic imaging material contains a reducible light-insensitive silver source (such as organic silver salts), a catalytically active amount of photocatalyst (such as silver halide) and a reducing agent, which are dispersed in a binder matrix. Such photothermographic materials are stable at ordinary temperature and, after exposure, form silver upon heating at a relatively high temperature (e.g., 80° C. or higher) through an oxidation reduction reaction between the reducible silver source (which functions as an oxidizing agent) and the reducing agent. The oxidation reduction reaction is accelerated by catalytic action of a latent image produced by the exposure. Silver formed through reaction of the reducible silver salt in exposed areas provides a black image, which contrasts with non-exposes areas, leading to image formation.

The photothermographic material employs organic silver salts as a reducible silver source, which can be obtained by mixing a water-soluble silver compound and an organic acid. To an organic acid, for example, an alkali metal salt (such as sodium hydroxide or potassium hydroxide) is added to form an organic acid alkali metal salt soap (such as sodium behenate or sodium arachidate) and then, the soap and silver nitrate are added by double jet addition to form an organic silver salt.

In the foregoing preparation process, however, it is difficult to convert all of the organic acid to an organic silver salt and not a little organic acid remains as an impurity. Although silver is formed through oxidation reduction reaction between a reducible silver source (acting as an oxidant) and a reducing agent upon heating at a relatively high temperature after exposure, this reaction is accompanied by conversion of at least a part of the organic silver salt to an organic acid. JP-A 50-57619 (hereinafter, the term, JP-A means unexamined and published Japanese Patent Application) discloses a technique for preventing photo-discoloration by further addition of an organic acid. Existence of a large amount of an organic acid in the layer produces a problem that the layer is softened and easily abraded. Such a problem becomes more marked and acute when the layer is further thinned.

Photothermographic materials are usually provided on a support with at least two functional layers comprised of an image forming layer (also called a light-sensitive layer) and a protective layer as a light-insensitive layer. Silver salt photothermographic materials capable of obtaining a high image density at a relatively low silver coverage are of interest for producers because the silver amount necessary to maintain a given density is saved, thereby reducing the coating amount of a light-sensitive emulsion and minimizing loads on coating and drying, and leading to enhanced productivity. Reduction of the silver coating amount also enables cost-reduction of the photographic material. However, maintaining or enhancing photographic performance along with reduction of silver coverage is extremely difficult to achieve. Such a problem becomes greater as layers such as a light-sensitive layer are further thinned, so that development of a technique effective for improving the foregoing problems has strongly been desired.

In cases where photothermographic imaging materials are used in laser imagers for medical use, with regard to image tone of the outputted image used for medical diagnosis, it has been supposed that more exact diagnostic observation results can be easily achieved with a cold image tone. The cold image tone refers to a pure black tone or bluish black tone and the warm image tone refers to a brownish black image exhibiting a warm tone. To overcome the foregoing problems is known incorporation of dyes into the interior of the photothermographic material or a support, as a technique for adjusting silver image tone. There are also known toning agents, as described in U.S. Pat. Nos. 4,123,282, 3,994,732, 3,846,136 and 4,021,249. However, such means for improvement are insufficient as image tone required in images for medical use and further improvements have been desired but a technique effective for improvement has not yet been found.

SUMMARY OF THE INVENTION

The present invention has been made in light of the foregoing problems. Thus, it is an object of the invention to provide a silver salt photothermographic imaging material with a relatively low silver coverage, exhibiting enhanced image quality and superior silver tone, image lasting quality and physical property of the layer; and an image recording method by the use thereof.

The object of the invention was accomplished by the following constitution:

1. A silver salt photothermographic material comprising on a support a light-sensitive layer comprising an organic silver salt, light-sensitive silver halide grains, a reducing agent and a binder, wherein after the photothermographic material having been developed at a temperature of not less than 100° C. is subjected to exposure to light of an illumination intensity of 300 lux at 45° C. for 24 hrs., the rate of variation in fog density between before and after exposure is not more than 30%, based on the fog density of the photothermographic material before exposure;

2. A photothermographic material comprising on a support a light-sensitive layer comprising an organic silver salt, light-sensitive silver halide grains, a reducing agent and a binder, wherein after the photothermographic material has been developed at a temperature of not less than 100° C., the light-sensitive layer exhibits a thermal transition point of 46 to 200° C.;
3. The photothermographic material as described in the foregoing 1 or 2, wherein the binder exhibits a glass transition temperature (Tg) of 70 to 105° C.;
4. The photothermographic material as described in any of the foregoing 1 through 3, wherein the binder is a polyvinyl acetal substantially having an acetoacetal structure;
5. A photothermographic material comprising on a support a light-sensitive layer comprising an organic silver salt, light-sensitive silver halide grains, a reducing agent and a binder, wherein the light-sensitive layer comprises an organic gelling agent;
6. The photothermographic material as described in the foregoing 5, wherein the organic gelling agent is a polyhydric alcohol;
7. The photothermographic material as described in the foregoing 5, wherein the organic gelling agent is a compound represented by the following formula (1) or (2):

formula (1)

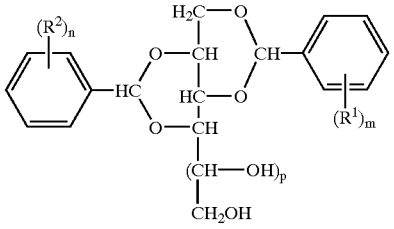

wherein $R^1$ and $R^2$, which may the same or different, are a hydrogen atom, an alkyl group having 1 to 4 carbon atoms, an alkoxy group having 1 to 4 carbon atoms or a halogen atom; m and n are each an integer of 1 to 5; p is 0 or 1, with proviso that when m is 2, two $R^1$s may combine with each other to form a tetralin ring together with a benzene ring linked with them, and that when n is 2, two $R^2$s may combine with each other to form a tetralin ring together with a benzene ring linked with the $R^2$s;

formula (2)

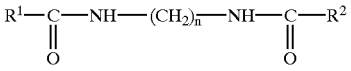

wherein $R^1$ and $R^2$, which may be the same or different, are 12-hydroxyoctadecyl or 12-hydroxyoctadecenyl; and n is an integer of 2 to 12;

8. The photothermographic material as described in any of the foregoing 1 through 7, wherein at least one of the light-sensitive layer and a light-insensitive layer comprises a silver-saving agent;
9. The photothermographic material as described in any of the foregoing 1 through 8, wherein the photothermographic material comprises a compound generating a labile species capable of oxidizing silver upon exposure to a ultraviolet ray or visible light and a compound generating a labile species capable of deactivating the reducing agent to make reduction to silver impossible upon exposure to a ultraviolet ray or visible light;
10. The photothermographic material as claimed in any of claims 1 through 9, wherein the light-sensitive layer comprises at least two layers;
11. An image recording method of a photothermographic material, wherein when recording an image on the photothermographic material as claimed in any of claim 1 through 10, exposure is conducted using a laser light scanning exposure machine of double beam scanning laser light;
12. An image recording method of a photothermographic material, wherein when recording an image on the photothermographic material as claimed in any of 1 through 10, exposure is conducted using a laser light scanning exposure machine of longitudinal multiple laser scanning light.
13. The photothermographic material as claimed in any one of 1 through 10, wherein the photothermographic material meets the requirement of $190° < h_{ab} < 260°$, in which $h_{ab}$ is a hue angle (as defined in JIS-Z 8729).

DETAILED DESCRIPTION OF THE INVENTION

One noble aspect of he present invention concerns a photothermographic material, wherein when the photothermographic material is subjected to thermal development at a temperature of not less than 100° C. and then further exposed to light of an illumination intensity of 300 lux at 45° C. for 24 hrs., the photothermographic material exhibits the rate of variation in fog density between before and after being exposed to light being not more than 30%, based on the fog density of the photothermographic material before being exposed to light.

Furthermore, preferred effects can be achieved by the embodiments described in the foregoing 2 through 7 and the use in combination with any one of the foregoing 8 through 10 leads to further enhanced effects of the invention.

The expression, the rate of variation in fog density being within 30%, based on the fog density of the photothermographic material before being subjected to exposure when the photothermographic material having been developed at a temperature of not less than 100° C. is subjected to exposure to light of an illumination intensity of 300 lux at 45° C. for 24 hrs. means that when exposed in an atmosphere of 45° C. for 24 hrs. to light of F-7 defined in the Commission International de I'Eclairage (CIE) that has transmitted through a white diffusion plate having a total light transmittance of 58%, a reflectance of 40% and a diffusivity of 84% and that has been adjusted to an illumination intensity of 300 lux, the rate of variation in fog density, represented by the following formula is not more than 30%:

$$\text{Rate of variation in fog density} = [(D_{Fog2} - D_{Fog1})/D_{Fog1}] \times 100\ (\%)$$

where $D_{Fog1}$ is the minimum density of the photothermographic material having been developed at a temperature of not less than 100° C. and unexposed to light of 300 lux, and $D_{Fog\ 2}$ is the minimum density of the photothermographic material having developed and then exposed to the light. Herein, the minimum density means a fog density.

In one preferred embodiment of the invention, the light-sensitive layer of the photothermographic material which has been thermally developed at a temperature of 100° C. or higher exhibits a thermal transition point of not less than 46° C. and not more than 200° C.

The thermal transition point in the invention refers to an endothermic peak obtained when subjecting the light-sensitive layer separated from the thermally developed photographic material to differential calorimery, using a differential scanning calorimeter (also denoted simply as DSC, for example, EXSTAR 6000, available from SEIKO DENSHI KOGYO Co., Ltd.; DSC 220C, available from SEIKO DENSHI KOGYO Co., Ltd; and DSC-7, available from Perkin Elmer Co.). In general, polymeric compounds have a glass transition point (Tg). It was found by the inventors of the present invention that when the light-sensitive layer separated from the thermally developed photothermographic material is subjected to differential calorimetry using a DSC, a great endothermic peak emerged, on its differential calorimetry curve, at a temperature lower than the Tg value of binder resin used in the light-sensitive layer. Thus, the thermal transition point defined in the invention is referred to as a temperature corresponding to this endothermic peak obtained by the differential calorimetry using a DSC. As a result of further study of this thermal transition point, it was proved that when the thermal transition temperature was set up so as to fall within the range of not less than 46° C. and not more than 200° C., softening of the coating layer was prevented, thereby minimizing abrasion marks.

In one preferred embodiment of the invention, the binder contained in the light-sensitive layer exhibits a glass transition point (Tg) of 70 to 105° C. The glass transition point can be determined by the foregoing differential scanning calorimeter and the glass transition point is defined as the crossing-point of the base line and the slope of the endothermic peak.

The glass transition point (Tg) can be determined in accordance with the method described in "Polymer Handbook" at page III-139 to III-179 (1966, published by Wirey and Sons).

In cases where the binder is a copolymer resin, Tg is defined by the following equation:

$$Tg(\text{copolymer})=v_1Tg_1+v_2Tg_2+\ldots+v_nTg_n$$

where $v_1$, $v_2$, . . . $v_n$ each represent a weight fraction of respective monomers of the copolymer; $Tg_1$, $Tg_2$, . . . $Tg_n$ each represent a glass transition point, Tg (° C.) of a homopolymer obtained by each of monomers constituting the copolymer. The precision of the Tg calculated by the foregoing equation is within ±5° C.

Next, photothermographic dry imaging materials relating to the invention will be described. The photothermographic material comprises on a support at least a light-sensitive layer. There may be provided a light-sensitive alone on the support and at least a protective layer is preferably provided on the light-sensitive layer. It is also preferred that at least two light-sensitive layer are provided on one side of the support, or at least one light-sensitive layer on each of both sides of the support. In one preferred embodiment of the invention, respective light-sensitive layers contain different silver-saving agents, antifoggants or image toning agents in addition to the organic silver salt, light-sensitive silver halide grains, reducing agent and binder.

As a method for providing plural functional layers described above on a support is cited sequential multi-layer coating system in which coating and drying are repeated for respective layers, including a roll coating system such as reverse roll coating or gravure roll coating, blade coating, wire-bar coating, and die coating. Alternatively, using plural coaters and before drying a coated layer, the next layer is coated and plural coated layers are simultaneously dried. Using slide coating or curtain coating described in Stephen F. Kistler & Petert M. Schweizer, "LIQUID FILM COATING" (CHAPMAN & HALL, 1997) at pages 399–536, a simultaneous multi-layer coating system is also applicable, in which plural coating solutions are layers on the slide surface to be coated. The most preferred coating method in the invention is extrusion coating. The extrusion coating is suitable for accurate coating or organic solvent coating since no evaporation occur on the slide surface, as in a slide coating system. Simultaneous multi-layer coating is detailed in JP-A No. 2000015173.

Organic Silver Salt

The organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (e.g., salts of gallic acid, oxalic acid, behenic acid, stearic acid, palmitic acid, lauric acid, etc.); carboxyalkylthiourea salts (e.g., 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (e.g., aldehydes such as formaldehyde, acetaldehyde, butylaldehyde), hydroxy-substituted acids (e.g., salicylic acid, benzoic acid, 3,5-dihydroxybenzoic acid, 5,5-thiodisalicylic acid, silver salts or complexes of thiones (e.g., 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and lH-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and/or stearic acid are specifically preferred. A mixture of two or more kinds of organic silver salts is preferably used, enhancing developability and forming silver images exhibiting relatively high density and high contrast. For example, preparation by adding a silver ion solution to a mixture of two or more kinds of organic acids is preferable.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

Organic silver salt grains may be of almost any shape but are preferably tabular grains. Tabular organic silver salt grains are specifically preferred, exhibiting an aspect ratio of 3 or more and a needle form ratio of not less than 1.1 and less than 10.0 of a needle form ratio measured from the major face direction, thereby lessen anisotropy in shape of substantially parallel, two faces having the largest area (so-called major faces). The more preferred needle form ratio is not less than 1.1 and less than 5.0.

The expression "comprises tabular organic silver salt grains exhibiting an aspect ratio of 3 or more" means that at least 50% by number of the total organic silver salt grains is accounted for by such tabular grains having an aspect ratio of 3 or more. The organic silver salt grains having an aspect ratio of 3 or more accounts for more preferably at least 60% by number, still more preferably at least 70% by number, and specifically preferably at least 80% by number. The tabular organic silver salt particle having an aspect ratio of 3 or more refers to an organic salt grain exhibiting a ratio of grain diameter to grain thickness, a so-called aspect ratio (also denoted as AR) of 3 or more, which is defined as below:

$$AR = \text{diameter } (\mu m)/\text{thickness } (\mu m).$$

The aspect ratio of tabular organic silver salt used in the invention preferably is 3 to 20, and more preferably 3 to 10.

Silver Halide Emulsion

Next, light-sensitive silver halide grains used in the invention will be described.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

In order to minimize cloudiness after image formation and to obtain excellent image quality, the less the average grain size, the more preferred, and the average grain size is preferably not more than 0.2 $\mu$m, more preferably between 0.01 and 0.17 $\mu$m, and still more preferably between 0.02 and 0.14 $\mu$m. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

$$\text{Coefficient of variation of grain size} = \text{standard deviation of grain diameter/average grain diameter} \times 100\ (\%)$$

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

In the preparation of silver halide grains, it is preferred to use a compound represent by the following formula, specifically in the nucleation stage:

$$YO(CH_2CH_2O)m(C(CH_3)CH_2O)p(CH_2CH_2O)nY$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno-compounds and other halogen containing compounds. These compounds are detailed in U.S. Pat. Nos. 4,009,039, 3,457,075 and 4,003,749, British Patent 1,498,956 and JP-A 53-27027 and 53-25420. As described above, silver halide can be formed by converting a part or all of an organic silver salt to silver halide through reaction of the organic silver salt and a halide ion. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide used in the invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

Silver halide grain emulsions used in the invention may be desalted after the grain formation, using the methods known in the art, such as the noodle washing method and flocculation process.

Silver-Saving Agent

In one preferred embodiment of the invention, the photothermographic material comprises at least a light-sensitive layer containing an organic silver salt, light-sensitive silver halide grains, a reducing agent and a binder, and at least one the light-sensitive layer and a light-insensitive layer preferably contains a silver-saving agent.

The silver-saving agent used in the invention refers to a compound capable of reducing the silver amount necessary to obtain a prescribed silver density. The action mechanism for the reducing function has been variously supposed and compounds having a function of enhancing covering power of developed silver are preferred. Herein the covering power of developed silver refers to an optical density per unit amount of silver. Examples of the preferred silver-saving agent include hydrazine derivative compounds represented by the following formula [H], vinyl compounds represented by formula (G) and quaternary onium compounds represented by formula (P):

formula [H]

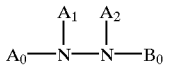

formula (G)

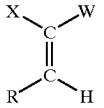

-continued formula (P)

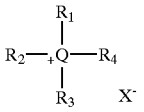

In formula [H], $A_0$ is an aliphatic group, aromatic group, heterocyclic group, each of which may be substituted, or —$G_0$-$D_0$ group; $B_0$ is a blocking group; $A_1$ and $A_2$ are both hydrogen atoms, or one of them is a hydrogen atom and the other is an acyl group, a sulfonyl group or an oxalyl group, in which Go is a —CO—, —COCO—, —CS—, —C(=$NG_1D_1$)—, —SO—, —$SO_2$— or —P(O) ($G_1D_1$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and Do is a hydrogen atom, an aliphatic group, aromatic group, heterocyclic group, amino group, alkoxy group, aryloxy group, alkylthio group or arylthio group. Do is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen, including residues of a pyrrolidine ring, imidazole ring, tetrahydrofuran ring, morpholine-ring, pyridine ring, pyrimidine ring, quinoline ring, thiazole-ring, benzthiazole ring, thiophene ring or furan ring. The aromatic group, heterocyclic group or —$G_0$-$D_0$ group represented by $A_0$ each may be substituted. Specifically preferred $A_0$ is an aryl group or —$G_0$-$D_0$ group.

$A_0$ contains preferably a non-diffusible group or a group for promoting adsorption to silver halide. As the non-diffusible group is preferable a ballast group used in immobile photographic additives such as a coupler. The ballast group includes an alkyl group, alkenyl group, alkynyl group, alkoxy group, phenyl group, phenoxy group and alkylphenoxy group, each of which has 8 or more carbon atoms and is photographically inert.

In Formula (H), $B_0$ is a blocking group, and preferably —$G_0$-$D_0$, wherein $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. Do is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

More preferred hydrazine compounds are represented by the following formulas (H-1), (H-2), (H-3) and (H-4):

formula (H-1)

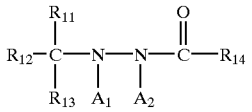

formula (H-2)

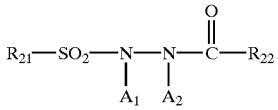

formula (H-3)

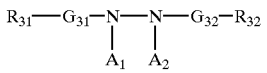

formula (H-4)

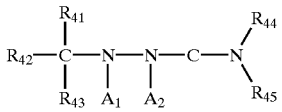

In formula (H-1), $R_{11}$, $R_{12}$ and $R_{13}$ are each a substituted or unsubstituted aryl group or substituted or unsubstituted heteroaryl group (i.e., an aromatic heterocyclic group). Examples of the aryl group represented by $R_{11}$, $R_{12}$ or $R_{13}$ include phenyl, p-methylphenyl and naphthyl and examples of the heteroaryl group include a triazole residue, imidazole residue, pyridine residue, furan residue and thiophene residue. $R_{14}$ is heterocyclic-oxy group or a heteroarylthio group, and preferably a pyridyloxy group and thienyloxy group.

$A_1$ and $A_2$ are both hydrogen atoms, or one of them is a hydrogen atom and the other is an acyl group (e.g., acetyl, trifluoroacetyl, benzoyl, etc.), a sulfonyl (e.g., methanesulfonyl, toluenesulfonyl, etc.), or oxalyl group (e.g., ethoxalyl, etc.). $A_1$ and $A_2$ preferably are both hydrogen atoms.

In formula (H-2), $R_{21}$ is a substituted or unsubstituted alkyl group, aryl group or heteroaryl group. $R_{21}$ is preferably an aryl group or a heterocyclic group, and more preferably a phenyl group.

$R_{22}$ is a hydrogen atom, an alkylamino group, an arylamino group, or heteroarylamino group, and preferably dimethylamino or diethylamino. $A_1$ and $A_2$ are the same as defined in formula (H-1).

In formula (H-3), $R_{31}$ and $R_{32}$ are each a univalent substituent group and the univalent substituent groups represented by $R_{31}$ and $R_{32}$ are the same as defined in $R_{11}$, $R_{12}$, and $R_{13}$ of formula (H-1), preferably an alkyl group, an aryl group, a heteroaryl group, an alkoxy group and an amino group, more preferably an aryl group or an alkoxy group, and specifically preferably, at least one of $R_{31}$ and $R_{32}$ t-butoxy and another preferred structure is that when $R_{31}$ is phenyl, $R_{32}$ is t-butoxycarbonyl. $G_{31}$ and $G_{32}$ are each a —(CO)p— or —C(=S)— group, a sulfonyl group, a sulfoxy group, a —P(=O)$R_{33}$— group, or an iminomethylene group, in which $R_{33}$ is an alkyl group, an alkenyl group, an alkynyl group, an aryl group, an alkoxy group, an alkenyloxy group, an alkynyloxy group, an arylamino group or an amino group, provided that when $G_{31}$ is a sulfonyl group, $G_{32}$ is not a carbonyl group. $G_{31}$ and $G_{32}$ are preferably —CO—, —COCO—, a sulfonyl group or —CS—, and more preferably —CO— or a sulfonyl group. $A_1$ and $A_2$ are the same as defined in $A_1$ and $A_2$ of formula (H-1).

In formula (H-4) $R_{41}$, $R_{42}$ and $R_{43}$ are the same as defined in $R_{11}$, $R_{12}$ and $R_{13}$. $R_{41}$, $R_{42}$ and $R_{43}$ are preferably substituted or unsubstituted phenyl group, and more preferably all of $R_{41}$, $R_{42}$ and $R_{43}$ are an unsubstituted phenyl group. $R_{44}$ and $R_{45}$ are each an unsubstituted alkyl group. $A_1$ and $A_2$ are the same as defined in $A_1$ and $A_2$ of formula (H-1).

The compounds of formulas (H-1) through (H-4) can be readily synthesized in accordance with methods known in the art, as described in, for example, U.S. Pat. No. 5,467,738 and 5,496,695.

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11. These hydrazine derivatives can be synthesized in accordance with commonly known methods.

In formula (G), X and R may be either cis-form or trans-form. The structure of its exemplary compounds is also similarly included.

In formula (G), X is an electron-withdrawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group.

R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group (e.g., sodium salt, potassium salt, silver salt, etc.), an amino group, a cyclic amino group (e.g., pyrrolidine), an acylamino group, anoxycarbonylamino group, a heterocyclic group (5- or 6-membered nitrogen containing heterocyclic group such as benztriazolyl, imidazolyl, triazolyl, or tetrazolyl), a ureido group, or a sulfonamido group. X and W, or X and R may combine together with each other to form a ring. Of the groups of X and W, the group having a thioether bond is preferred.

In formula (P), Q is a nitrogen atom or a phosphorus atom; $R_1$, $R_2$, $R_3$ and $R_4$ each are a hydrogen atom or a substituent, provided that $R_1$, $R_2$, $R_3$ and $R_4$ combine together with each other to form a ring; and $X^-$ is an anion.

Further, quaternary onium salt compounds usable in the invention include compounds represented by formulas (Pa), (Pb) and (Pc), or formula (T):

formula (Pa)

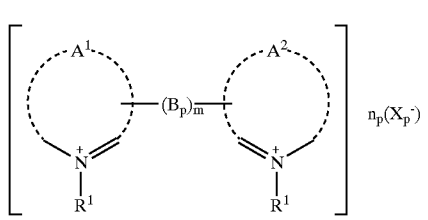

-continued formula (Pb)

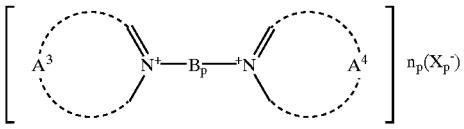

formula (Pc)

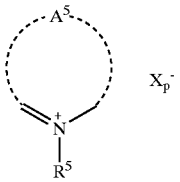

wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$, which may be the same or different, may be substituted by a substituent. Exemplary preferred $A^1$, $A^2$, $A^3$, $A^4$ and $A^5$ include a S- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted. $X_p^-$ is a counter ion necessary to counterbalance overall charge of the molecule, such as chloride ion, bromide ion, iodide ion, sulfate ion, nitrate ion and p-toluenesulfonate ion; $n_p$ is a counter ion necessary to counterbalance overall charge of the molecule and in the case of an intramolecular salt, $n_p$ is 0.

formula (T)

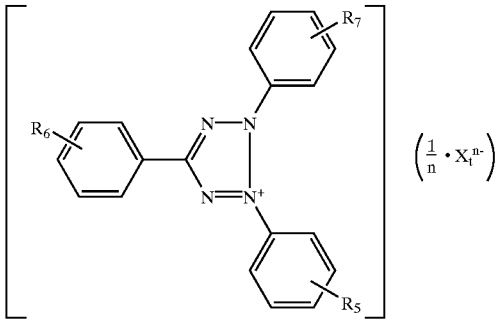

In formula (T), substituent groups $R_5$, $R_6$ and R7, substituted on the phenyl group are preferably a hydrogen atom or a group exhibiting a negative Hammett's σ-value. The Hammett's σ-value represents electron-attractivity.

The σ values of the substituent on the phenyl group are disclosed in lots of reference books. For example, a report by C. Hansch in "The Journal of Medical Chemistry", vol.20, on page 304(1977), etc. can be mentioned. Groups showing particularly preferable negative σ-values include, for example, methyl group ($\sigma_p$=−0.17, and in the following, values in the parentheses are in terms of $\sigma_p$ value), ethyl group (−0.15), cyclopropyl group (−0.21), n-propyl group (−0.13), iso-propyl group (−0.15), cyclobutyl group (−0.15), n-butyl group (−0.16), iso-butyl group (−0.20), n-pentyl group (−0.15), n-butyl group (−0.16), iso-butyl group (−0.20), n-pentyl group (−0.15), cyclohexyl group (−0.22), hydroxyl group (−0.37), amino group (−0.66), acetylamino group (−0.15), butoxy group (−0.32), pentoxy group (−0.34), etc. can be mentioned. All of these groups are useful as the substituent for the compound represented by the formula T according to the present invention; n is 1 or 2, and as anions represented by $X_T^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic acid anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

The quaternary onium salt compounds described above can be readily synthesized according to the methods commonly known in the art. For example, the tetrazolium compounds described above may be referred to Chemical Review 55, page 335–483. The foregoing silver-saving agent is preferably contained in an amount of $10^{-5}$ to 1 mol, and more preferably $10^{-4}$ to $5\times10^{-1}$ mol per mol organic silver salt.

Antifoggant and Image Stabilizer

The difference in constitution between a conventional silver salt photographic material and a photothermographic imaging material is that the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection.

Next, antifoggants and image stabilizers used in the photothermographic imaging material relating to the invention will be described. In one preferred embodiment of the invention, the photothermographic material contains at least two compounds selected from the group of a compound generating a labile species capable of oxidizing silver upon exposure to an infrared or visible light and a compound generating a labile species capable of deactivating the reducing agent to render impossible reduction to silver upon exposure to a ultraviolet ray or visible light.

As a reducing agent used in the photothermographic materials relating to the invention are employed reducing agents containing a proton, such as bisphenols and sulfonamidophenols. Accordingly, a compound generating a labile species which is capable of abstracting a proton to deactivate the reducing agent is preferred. More preferred is a compound as a non-colored photo-oxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure. Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds and iodonium compounds.

Of such imidazolyl compounds, a compound represented by the following formula (3) is preferred:

formula (3)

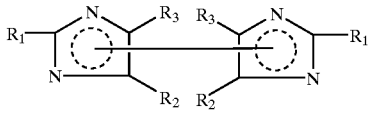

wherein $R_1$, $R_2$ and $R_3$ (, which may be the same or different) each are a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a hydrogen atom, a halogen atom, an aryloxyl (e.g., phenoxy), an alkylthio group (e.g., methylthio, butylthio), an arylthio group (e.g., phenylthio), a heterocyclic group (e.g., pyridyl, triazyl), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, a heterocyclic group, an alkenyl group and cyano group.

The biimidazolyl compounds can be synthesized in accordance with the methods described in U.S. Pat. No. 3,734,733 and British Patent 1,271,177. Preferred Examples thereof are shown below.

Similarly preferred compounds include a iodonium compound represented by the following formula (4):

Formula (4)

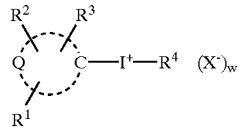

wherein Q is a group of atoms necessary to complete a 5-, 6-, or 7-membered ring, and the atoms being selected from a carbon atom, nitrogen atom, oxygen atom and sulfur atom; and $R^1$, $R^2$ and $R^3$ (, which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, an alkenyl group and cyano group, provided that $R_1$, $R^2$ and R3 may be bonded with each other to form a ring; $R^4$ is a carboxylate group such as acetate, benzoate or trifluoroacetate, or $O^-$; W is 0 or 1, provided that when $R^3$ is a sulfo group or a carboxy group, W is 0 and $R^4$ is $O^-$; $X^-$ is an anionic counter ion, including $CH_3CO_2$—, $CH_3SO_3$— and $PF_6^-$.

Of these is specifically preferred a compound represented by the following formula (5):

formula (5)

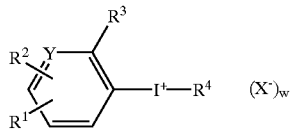

wherein $R^1$, $R^2$, $R^3$, $R^4$, $X^-$ and W are each the same as defined in formula [2]; Y is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961).

The compound releasing a labile species other than a halogen atom, such as represented by formula (3) or (4) is incorporated preferably in an amount of 0.001 to 0.1 mol/$m^2$, and more preferably 0.005 to 0.05 mol/$m^2$. The compound may be incorporated into any component layer of the photothermographic material relating to the invention and is preferably incorporated in the vicinity of a reducing agent.

As a compound capable of deactivating a reducing agent to inhibit reduction of an organic silver salt to silver by the reducing agent are preferred compounds releasing a labile species other than a halogen atom. However, these compounds may be used in combination with a compound capable of releasing a halogen atom as a labile species. There are also known many compound generating a halogen atom as a labile species and their combined use results in superior effects.

Examples of the compound releasing an active halogen atom include a compound represented by the following formula (6):

formula (6)

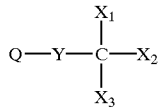

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(═O)—, —SO— or —$SO_2$—. The aryl group represented by Q may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group.

The heterocyclic group represented by Q is a 3- to 10-membered, saturated or unsaturated heterocyclic group containing at least one of N, O and S, which may be a monocyclic or condensed with another ring to a condensed ring. The heterocyclic group preferably is a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed.

The aryl group or heterocyclic group represented by Q may be substituted by a substituent, in addition to —Y—C ($X_1$) ($X_2$) ($X_3$). Y is —C(=O)—, —SO—, and —$SO_2$—, and preferably —$SO_2$—.

The amount of this compound to be incorporated is preferably within the range in which an increase of printed-out silver caused by formation of silver halide arises substantially no problem, more preferably not more than 150% by weight and still more preferably not more than 100% by weight, based on the compound releasing no active halogen atom.

Further, in addition to the foregoing compounds, compounds commonly known as an antifoggant may be incorporated in the photothermographic imaging material used in the invention. In such a case, the compounds may be those which form a labile species similarly to the foregoing compounds or those which are different in antifogging mechanism. Examples thereof include compounds described in U.S. Pat. Nos. 3,589,903, 4,546,075 and 4,452,885; JP-A No. 59-57234; U.S. Pat. Nos. 3,874,946 and 4,756,999; and JP-A Nos. 9-288328 and 9-90550. Further, other antifoggants include, for example, compounds described in U.S. Pat. No. 5,028,523 and European patent Nos. 600,587, 605,981 and 631,176.

In the invention, at least two compounds selected from the compounds represented by formulas (3) through (6) are preferably used in combination. Photothermographic materials exhibiting more preferable image tone can be obtained when the silver-saving agent and at least two compounds selected from the compounds represented by formulas (3) through (6) are used in combination.

Reducing Agent

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and an optimum reducing agent can be used by the selection from those commonly known in the art. In cases where fatty acid silver salts are used as an organic silver salt, polyphenols in which at least two phenyl groups are linked through an alkylene group or a sulfur atom and specifically, bisphenols in which two phenyl groups which are substituted, at the position adjacent to the hydroxy group-substituted position, with at least an alkyl group (e.g., methyl, ethyl, propyl, t-butyl, cyclohexyl, etc.) or an acyl group (e.g., acetyl, propionyl, etc.) are linked through an alkylene group or a sulfur atom. For example, the compound represented by the following formula (A) is preferred:

formula (A)

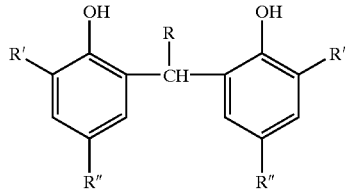

wherein R represents a hydrogen atom or an alkyl group having from 1 to 10 carbon atoms (for example, isopropyl, —$C_4H_9$, 2,4,4-trimethylpentyl), and R' and R" each represent an alkyl group having from 1 to 5 carbon atoms (for example, methyl, ethyl, t-butyl).

In addition to the foregoing compounds, examples of the reducing agents include polyphenol copounds described in U.S. Pat. No. 3.589,903 and 4,021,249; British patent No. 1,486,148; JP-A Nos. 51-51933, 50-36110, 50-116023 and 52-84727; JP-B No. 51-35727 (hereinafter, the term, JP-B means a published Japanese Patent); bisnaphthols described in U.S. Pat. No. 3,672,904, such as 2,2'-dihydroxy-1,1'-binaphthyl and 6,6'-dibromo-2,2'-dihydoxy-1,1'-binaphthyl; sulfonamidophenols and sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The amount of the reducing agent used in the photothermographic imaging material is variable depending on the kind of an organic silver salt or reducing agent and is usually 0.05 to 10 mol, and preferably 0.1 to 3 mol per mol of organic silver salt. Two or more reducing agents may be used in combination, in an amount within the foregoing range. Addition of the reducing agent to a light sensitive emulsion comprising a light sensitive silver halide, organic silver salt grains and a solvent immediately before coating the emulsion is often preferred, thereby minimizing variation in photographic performance during standing.

Chemical Sensitizer

Silver halide grains used in the invention can be subjected to chemical sensitization. In accordance with methods described in Japanese Patent Application Nos. 2000-57004 and 2000-61942, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double bond. The amount of a chalcogen compound added as an organic sensitizer is variable, depending on the chalcogen compound to be used, silver halide grains and a reaction environment when subjected to chemical sensitization and is preferably 10-8 to 10-2 mol, and more preferably $10^{-7}$ to 10-3 mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

In photothermographic imaging materials used in the invention, it is preferred to use a light sensitive emulsion, in which light sensitive silver halide has been subjected to chemical sensitization using a chalcogen atom-containing organic sensitizer at a temperature of 30° C. or higher, concurrently in the presence of an oxidizing agent capable of oxidizing silver specks formed on the silver halide grains, then, mixed with an organic silver salt, dehydrated and dried.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3.

Stabilizer

Chemical sensitization using the foregoing organic sensitizer is also preferably conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1, 2, 4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

Spectral Sensitizing Dye

Light sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A NOs. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

Specifically, preferred sensitizing dyes are dyes represented by the following formulas (S1) through (S4):

Formula (S1)

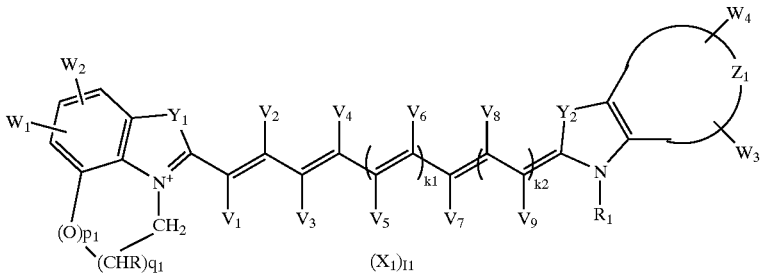

-continued

Formula (S2)

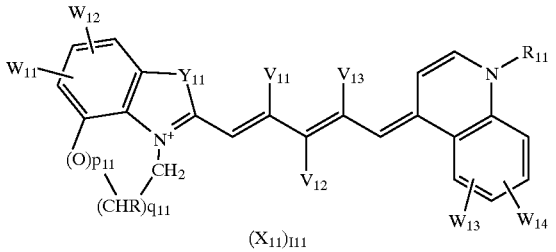

$(X_{11})_{l11}$

Formula (S3)

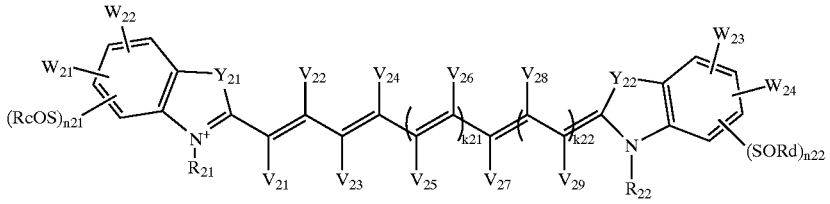

$(X_{21})_{l21}$

Formula (S4)

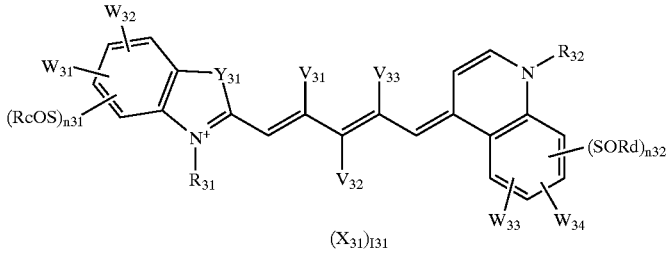

$(X_{31})_{l31}$

In formulas (S1) through (S4), $Y_1$, $Y_2$, $Y_{11}$, $Y_{21}$, $Y_{22}$ and $Y_{31}$ each are independently an oxygen atom, a sulfur atom, a selenium atom, —C(Ra)(Rb)— group or —CH=CH— group, in which Ra and Rb each are a hydrogen atom, an alkyl group (preferably having 1 to 5 carbon atoms) or a non-metallic atom group necessary to form an aliphatic spiro ring; $Z_1$ is a non-metallic atom group necessary to form a 5- or 6-membered ring; $R_1$, $R_{11}$, $R_{21}$, $R_{22}$, $R_{31}$, and $R_{32}$ each are an aliphatic group or a non-metallic atom group necessary to form a condensed ring between $R_1$ and $W_3$ or between $R_{11}$ and $W_{14}$; Rc and Rd each are independently an unsubstituted lower alkyl group, a cycloalkyl group, an aralkyl group, an aryl group or a heterocyclic group; $W_1$, $W_2$, $W_3$, $W_4$, $W_{11}$, $W_{12}$, $W_{13}$, $W_{14}$, $W_{21}$, $W_{22}$, $W_{23}$, $W_{24}$, $W_{31}$, $W_{32}$, $W_{33}$ and $W_{34}$ each are independently a hydrogen atom, a substituent or a non-metallic atom group necessary to form a condensed ring by bonding between $W_1$ and $W_2$, $W_{11}$ and $W_{12}$, $W_{21}$ and $W_{22}$, $W_{23}$ and $W_{24}$, $W_{31}$ and $W_{32}$, or $W_{33}$ and $W_{34}$; $V_1$ to $V_9$, $V_{11}$ to $V_{13}$, $V_{21}$ to $V_{29}$, and $V_{31}$ to $V_{33}$ each are independently a hydrogen atom, a halogen atom, an amino group, an alkylthio group, an arylthio group, a lower alkyl group, a lower alkoxyl group, an aryl group, an aryloxyl group, a heterocyclic group or a non-metallic atom group necessary to form a 5- to 7-membered ring by bonding between $V_1$ and $V_3$, $V_2$ and $V_4$, $V_3$ and $V_5$, $V_2$ and $V_6$, $V_5$ and $V_7$, $V_6$ and $V_8$, $V_7$ and $V_9$, $V_{11}$, and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, or $V_{31}$ and $V_{33}$; $X_{21}$ and $X_{31}$, provided that at least one of $V_1$ to $V_9$ and at least one of $V_{11}$ to $V_{13}$ are a group other than a hydrogen atom; $X_1$, $X_{11}$, $X_{21}$ and $X_{31}$ each are an ion necessary to compensate for an intramolecular charge; l1, l11, l21 and l31 each an ion necessary to compensate for an intramolecular charge; k1, k2, k31 and k32 each are 0 or 1; n21, n22, n31 and n32 each are 0, 1 or 2;, provided that n1 and n22, and n31 and n32 are not 0 at the same time; p1 and p11 are each 0 or 1; q1 and q11 each are 1 or 2, provided that the sum of p1 and q1 and the sum of p11 and q11 each are respectively not more than 2.

The infrared sensitizing dye according to the invention is preferably a dye characterized in that a three ring-condensed heterocyclic nucleus is formed by bonding between a nitrogen atom contained in a benzothiazole ring and a carbon atom at a peri-position; or that the dye is a long chain polymethine dye, in which a sulfonyl group is substituted on the benzene ring of the benzothiazole ring.

The infrared sensitizing dyes and spectral sensitizing dyes described above can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed to silver halide grains, chemical sensitization is conducted, thereby preventing dispersion of chemical sensitization center specks and achieving enhanced sensitivity and minimized fogging.

Supersensitizer

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion containing silver halide grains and organic silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

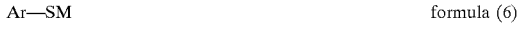

Ar—SM formula (6)

wherein M is a hydrogen atom or an alkali metal atom; Ar is an aromatic ring or condensed aromatic ring containing a nitrogen atom, oxygen atom, sulfur atom, selenium atom or tellurium atom. A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

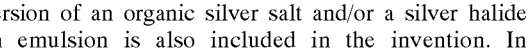

Ar—S—S—Ar Formula (7)

wherein Ar is the same as defined in the mercapto compound represented by the formula described earlier.

The aromatic heterocyclic rings described above may be substituted with a halogen atom (e.g., chlorine, brimine, iodine), a hydroxy group, an amino group, a carboxy group, an alkyl group (having one or more carbon atoms, and preferablyl to 4 carbon atoms) or an alkoxy group (having one or more carbon atoms, and preferably to 4 carbon atoms).

In addition to the foregoing supersensitizers, a compound represented by formula (1) described in Japanese Patent Application No. 2000-70296 and a macrocyclic compound may be used in combination as a supersensitizer. The supersensitizer is incorporated into the emulsion layer containing an organic silver salt and silver halide grains, preferably in an amount of 0.001 to 1.0 mol, and more preferably 0.01 to 0.5 mol per mol of silver.

Binder

In the photothermographic materials relating to the invention, the light-sensitive layer provided on the support, which contains an organic silver salt, light-sensitive silver halide grains and a reducing agent, further contains a binder having characteristics described below.

The binder preferably exhibits a glass transition point (Tg) of 70 to 105° C. The use of such a binder prevents softening of the layer, due to an organic acid and raises the thermal transition point temperature, thereby resulting marked effects in prevention of abrasion marks. The use of a binder exhibiting a glass transition point of less than 70° C. lowers the thermal transition point and desired physical property values including abrasion mark cannot be achieved. Further, the use of a binder exhibiting a glass transition point higher than 105° C. results in markedly lowered physical properties.

There can be employed commonly known polymeric compounds as a binder. The glass transition point is preferably 70 to 105° C.; the number average molecular weight is preferably 1,000 to 1,000,000, and more preferably 10,000 to 500,000; and the degree of polymerization is preferably 50 to 1000. Examples thereof include compounds of a polymer or copolymer containing ethylenically unsaturated monomers as a constituting unit, such as vinyl chloride, vinyl acetate, vinyl alcohol, maleic acid, acrylic acid, acrylic acid ester, vinylidene chloride, acrylonitrile, methacrylic acid, methacrylic acid ester, styrene, butadiene, ethylene, vinyl butyral, vinyl acetal and vinyl ether; polyurethane resin, and various kinds of rubber resin. In addition thereto, phenol resin, epoxy resin, polyurethane thermally hardening type resin, urea resin, melamine resin, alkyd resin, formaldehyde resin, silicone resin, epoxy-polyamide resin, and polyester resin are also usable. These resins are detailed in "Plastic Handbook" published by Asakura-shoten. The foregoing polymeric compounds are not specifically limited and there is usable any one having a glass transition point (Tg) of 70 to 105° C., including homopolymers and copolymers.

Examples of polymer containing an ethylenically unsaturated monomer as a constituting unit and its copolymer include acrylic acid alkyl esters, acrylic acid aryl esters, methacrylic acid alkyl esters, methacrylic acid aryl esters, cyanoacrylic acid alkyl esters, and cyanoacrylic acid aryl esters, in which the alkyl or aryl group may be substituted. Examples of substituent groups include methyl, ethyl, n-propyl, isopropyl, n-butyl, isobutyl, sec-butyl, tert-butyl, amyl, hexyl, cyclohexyl, benzyl, chlorobenzyl, octyl, stearyl, sulfopropyl, N-ethyl-phenylethyl,, 2-(3-phenylpropyloxy)ethyl, dimethylaminophenoxyethyl, furfuryl, tetrahydrofurfuryl, phenyl, cresyl, naphthyl, 2-hydroxyethyl, 4-hydroxybutyl, triethylene glycol, dipropylene glycol, 2-methoxyethyl, 3-methoxybutyl, 2-aetoxyethyl, 2-acetoxyacetoxyethyl, 2-ethoxyethyl, 2-isopropoxy, 2-butoxyethyl, 2-(2-methoxy)ethyl, 2-(2-ethoxyethoxy)ethyl, 2-(2-butoxyethoxy)ethyl, 2-diphenylphosphorylethyl, ω-methoxyethylene glycol (addition mole number n=6)allyl, and a dimethylaminoethyl chloride salt. In addition, the following monomers are also usable, including vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate; N-substituted acrylamides, N-substituted methacrylamides, acrylamides and methacrylamides, in which N-substituting groups include, for example, methyl, ethyl, propyl, butyl, tert-butyl, cyclohexyl, benzyl, hydroxymethyl, methoxyethyl, dimethylaminoethyl, phenyl, dimethyl, diethyl, β-cyanoethyl, N-(2-acetoacetoxyethyl) and diacetone; olefins such as dicyclopentadiene, ethylene, propylene, 1-butene, 1-pentene, vinyl chloride, vinylidene chloride, isoprene, chloprene, butadiene, and 2,3-dimethylbutadiene; styrenes such as methylstyrene, dimethylstyrene, trimethylstyrene, ethylstyrene, isopropylstyrene, tert-butylstyrene, chloromethylstyrene, methoxystyrene, acetoxystyrene, chlorostyrene, dichlorostyrene, bromostyrene, and methyl vinylbenzoate; vinyl ethers such as methyl vinyl ether, butyl vinyl ether, hexyl vinyl ether, methoxyethyl vinyl ether, and dimethylaminoethyl vinyl ether; N-substituted maleimides, in which N-substituting groups include, for example, methyl, ethyl, propyl, butyl, tert-butyl, cyclohexyl, benzyl, n-dodecyl, phenyl, 2-methylphenyl, 2,6-diethylphenyland 2-chlorophenyl; and others such as butyl crotonate, hexyl crotonate, dimethylitaconate, dibutyl itaconate, diethyl maleate, dimetyl maleate, dibutyl maleate, diethyl fumarate, dimethyl fumarate, dibutyl fumarate, methyl vinyl ketone, phenyl vinyl ketone, methoxy ethyl ketone, glycidyl acrylate, glycidyl methacrylate, N-vinyl oxazolidone, N-vinyl pyrrolidone, acrylonitrile, methacrylonitrile, methylene malonitrile, and vinylidene chloride.

Of these polymer compounds are preferred methacrylic acid alkyl esters, methacrylic acid aryl esters and styrenes. Specifically, polymer compounds containing an acetal group are preferred, which are superior in miscibility with organic acids produced, preventing softening of the layer.

In the invention, the binder is preferably polyvinyl acetal, which substantially has an acetoacetal structure and examples thereof include polyvinyl acetals described in U.S. Pat. Nos. 2,358,836, 3,003,879 and 2,828,204;and British Patent No. 771,155.

The polymer compound containing an acetal group is preferably represented by the following formula (V):

formula (V)

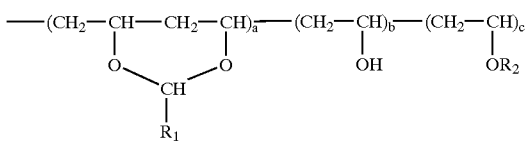

wherein $R_1$ is an unsubstituted alkyl group, a substituted alkyl group, and a substituted aryl group; $R_2$ is an unsubstituted alkyl group, a substituted alkyl group, a unsubstituted aryl group, a substituted aryl group, —$CONHR_3$ or —$COR_3$, in which $R_3$ is the same as defined in $R_1$.

The unsubstituted alkyl group represented by $R_1$, $R_2$ and $R_3$ is preferably one having 1 to 20 carbon atoms, and more preferably 1 to 6 carbon atoms, which may be straight chain or branched, and preferably straight chain. Examples of such an unsubstituted alkyl group include methyl, ethyl, n-propyl, isopropyl, n-butyl, isobutyl, t-butyl, n-amyl, t-amyl, n-hexyl, cyclohexyl, n-heptyl, n-octyl, t-octyl, 2-ethylhexyl, n-nonyl, n-decyl, n-dodecyl, and n-octadecyl. Specifically, methyl or propyl group is preferred.

The unsubstituted aryl group is preferably one having 6 to 20 carbon atoms, such as phenyl or naphthyl. Examples of a group capable of being substituted on the alkyl or aryl group include an alkyl group (e.g., methyl, n-propyl, t-amyl, t-octyl, n-nonyl, dodecyl, etc.), aryl group (e.g., phenyl), nitro group, hydroxy group, cyano group, sulfo group, alkoxy group (e.g., methoxy), aryloxy group (e.g., phenoxy), acyloxy group (e.g., acetoxy), acylamino group (e.g., acetylamino), sulfonamido group (e.g., methanesulfonamido), sulfamoyl group (e.g., methylsufamoyl), halogen atom (e.g., fluorine, chlorine, bromine atoms), carboxy group, carbamoyl group (e.g., methylcarbamoyl), alkoxycarbonyl group (e.g., methoxycarbonyl), and sulfonyl group (e.g., methylsufonyl). In cases where two or more substituent groups are contained, the substituent groups may be the same or different. The total number of carbon atoms of the substituted alkyl group is preferably 1 to 20, and that of the substituted aryl group is preferably 6 to 20.

$R_2$ is preferably —$COR_3$ (in which $R_3$ is an alkyl or aryl group) or —$CONHR_3$ (in which $R_3$ is an aryl group); a, b and c each are the weight of respective repeating units, expressed in terms of mol %, and a is 40 to 86 mol %, b is 0 to 30 mol % and c is 0 to 60 mol %, provided that a+b+c=100 mol %, a is preferably 50 to 86 mol %, b is preferably 5 to 25 mol % and c is preferably 0 to 40 mol %. The respective repeating units having composition ratio, a, b and c may be the same or different.

Polyurethane resins having commonly known structures are usable in the invention, such as polyester-polyurethane, polyether-polyurethane, polyether-polyester-polyurethanepolycarbonate-polyurethane, polyester-polycarbonate-polyurethane, and polycaprolactone-polyurethane. In the foregoing polyurethanes, at least one polar group selected from —COOM, —$SO_3M$, —$OSO_3M$, —P═O$(OM)_2$, —O—P═$(OM)_2$ (in which M is a hydrogen atom or an alkali metal salt), —$NR_2$, —$N^+R_2$ (in which $R_2$ is a hydrocarbon group), epoxy group, —SH, and —CN is preferably introduced in copolymerization or addition reaction. Such a polar group is preferably contained in an amount of $10^{-8}$ to $10^{-1}$ mol/g, and more preferably $10^{-6}$ to $10^{-2}$ mol/g. In addition to the polar group, it is preferred to contain at least one OH group on the end of a polyurethane molecule, i.e., at least two Oh groups in total. The OH group is capable of reacting with a polyisocyanate as a hardening agent to form a three-dimensional network structure so that the more is contained in the molecule, the more preferred. Specifically, the OH group on the molecular end, which exhibits relatively high reactivity is preferred. Polyurethane having at least three OH groups (and preferably at least four OH groups) on the molecular end is preferred. Specifically, polyurethane exhibiting a glass transition point of 70 to 105° C., a rupture elongation of 100 to 2000% and a rupture stress of 0.5 to 100 N/$mm^2$ is preferred.

Polymer compounds represented by the foregoing formula (V) can be synthesized in accordance with commonly known methods, as described, for example, in "Vinyl Acetate Resin" edited by Ichiro Sakurada (KOBUNSHIKAGAKU KANKOKAI, 1962). Exemplary syntheses are shown below, but are by no means limited to these examples.

Synthesis 1: Synthesis of P-1

To 180 g of pure water was added 20 g of polyvinyl alcohol (GOSENOL GH18, available from NIPPON GOSEI Co., Ltd.) to prepare an aqueous 10 wt % polyvinyl alcohol dispersion. After polyvinyl alcohol was dissolved by raising the temperature is raised to 95° C., the solution was cooled to 75° C. to obtain an aqueous polyvinyl alcohol solution. To the aqueous polyvinyl alcohol solution was added 1.6 g of 10 wt % hydrochloric acid as an acid catalyst (which was denoted as dropping solution A) Then, 11.5 g of a mixture of butylaldehyde and acetoaldehyde in a molar ratio of 1:1 was prepared (which was denoted as dropping solution B). To 1000 ml four-necked flask provided with a cooling tube and a stirring apparatus, 100 ml pure water was added and strongly stirred with heating to 85° C. Using a dropping funnel maintained at 75° C., dropping solutions A and B were simultaneously dropwise added in 2 hrs., with stirring. The reaction was carried out, while preventing coagulation of precipitates by controlling the stirring speed. After completion of the dropwise addition, 7 g of 10 wt % hydrochloric acid was added thereto as an acid catalyst and stirred fir 2 hrs. at 85° C. to complete the reaction. Thereafter, the reaction mixture was cooled to 40° C. and neutralized with sodium bicarbonate. After repeating washing five times, filtered polymer product was separated and dried to obtain P-1. The thus obtained P-1 was measured with using a differential scanning calorimeter (DSC) to determine Tg and the Tg was proved to be 75° C.

Other polymer compounds, as shown in Table 1 were synthesized in a similar manner. These polymer compounds may be used singly or in a blended form of at least two thereof. The layer containing light-sensitive silver salt (preferably, light-sensitive layer) preferably contains the foregoing polymer compounds as a main binder. The main binder refers to the state in which at least 50% by weight of the total binder of the light-sensitive silver salt-containing layer is accounted for by the foregoing polymer. Accordingly, other polymer(s) may be blended within the range of less than 50% by weight of the total binder. Such polymer(s) are not specifically limited so long as a solvent capable of dissolving the foregoing polymer is used. Examples of such polymer(s) include polyvinyl acetate, polyacryl resin and polyurethane resin.

The composition of the foregoing polymers and a comparative polymer are shown below, in which Tg was determined using a differential scanning calorimeter (DSC, produced by SEIKO DENSHI KOGYO Co., Ltd.).

TABLE 1

| | $R_{51}$ | | a | c ($R_{52}$) | b | |
|---|---|---|---|---|---|---|
| Polymer | $CH_3$ (mol %) | $C_3H_7$ (mol %) | Total Acetal (mol %) | $CH_3CO$ (mol %) | OH (mol %) | Tg (° C.) |
| P-1 | 60 | 40 | 73.7 | 1.7 | 24.6 | 83 |
| P-2 | 30 | 70 | 75.0 | 1.6 | 23.4 | 75 |
| P-3 | 100 | 0 | 73.6 | 1.9 | 24.5 | 104 |
| P-4 | 70 | 30 | 71.1 | 1.6 | 27.3 | 88 |
| P-5 | 90 | 10 | 71.8 | 1.5 | 26.7 | 99 |
| P-6 | 80 | 20 | 71.4 | 1.6 | 27.0 | 90 |
| P-7 | 30 | 70 | 70.4 | 1.6 | 28.0 | 76 |
| P-8 | 30 | 70 | 77.4 | 1.6 | 21.0 | 74 |
| Comp-1 | — | — | — | — | — | 60 |
| Comp-2 | — | — | — | — | — | 131 |

In Table 1, Comp-1 is polyvinyl butyral B-79 (available from SOLUTIA Co.).

Comp-2

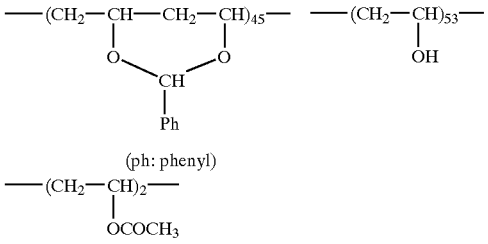

Organic Gelling Agent

The light-sensitive layer preferably contains an organic gelling agent. The organic gelling agent refers to a compound having a function of providing a yield value to a system and removing or lowering fluidity of the system when added to organic liquid. In the invention, the organic gelling agent is preferably polyhydric alcohols. Polyhydric alcohols usable in the invention are not specifically limited but preferably selected from compounds represented by the following formulas (I) to (VIII):

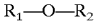

formula (I)

wherein $R_1$ is an alkyl group, alkenyl group, cycloalkyl group or cycloalkenyl; $R_2$ is an alkyl group, alkenyl group, cycloalkyl group, cycloalkenyl, —C(=O)—$R_3$, —$SO_2$—$R_4$, —(O=) P<($OR_5$) ($OR_6$), —(O=) P<($R_7$) ($R_8$), —C(=O)—N<($R_9$) ($R_{10}$) or —$SO_2$N<($R_{11}$) ($R_{12}$), in which $R_3$ through $R_9$ and $R_{11}$ are each an alkyl group, alkenyl group, cycloalkyl group, cycloalkenyl group, or aryl group; $R_{10}$ and $R_{12}$ are each a hydrogen atom, an alkyl group, alkenyl group, cycloalkyl group, cycloalkenyl group, or aryl group, provided that at least one position on carbon atoms of the alkyl group, alkenyl group, cycloalkyl group, and cycloalkenyl group represented by $R_1$ and/or the alkyl group, alkenyl group, cycloalkyl group, and cycloalkenyl group represented by $R_2$ and/or the alkyl group, alkenyl group, cycloalkyl group, and cycloalkenyl group represented by $R_3$ through $R_{12}$ is substituted by a hydroxy group and the total number of alcoholic hydroxy groups in the molecule is not less than 2, and $R^1$ and $R_2$ may combine with each other to form a ring;

formula (II)

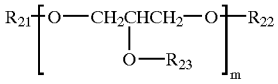

wherein $R_{21}$, $R_{22}$ and $R_{23}$ are each a hydrogen atom or an alkyl group, alkenyl group, cycloalkyl group, cycloalkenyl group, acyl group, sulfonyl group, phosphonyl group, carbamoyl group or sulfamoyl group; m is an integer of 1 to 20, provided that when m is 2 or more, plural "m"s may be the same or different, and when m is 1, two of $R_{21}$, $R_{22}$ and $R_{23}$ are hydrogen atoms but all of them are not hydrogen atoms at the same time;

formula (III)

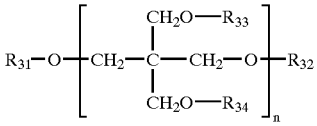

wherein $R_{31}$ through $R_{34}$ are each a hydrogen atom or an alkyl group, alkenyl group, cycloalkyl group, cycloalkenyl group, acyl group, sulfonyl group, phosphonyl group, carbamoyl group or sulfamoyl group; n is an integer of 1 to 20, provided that when n is 2 or more, plural $R_{33}$s and $R_{34}$s are respectively the same or different, and when n is 1, at least two of $R_{31}$, $R_{32}$, $R_{33}$ and $R_{34}$ are hydrogen atoms and all of them are not hydrogen atoms at the same time, when n is 2 or more, at least two of $R_{31}$, $R_{32}$, plural $R_{33}$s and $R_{34}$s are hydrogen atoms but all of them are not hydrogen atoms at the same time;

formula (IV)

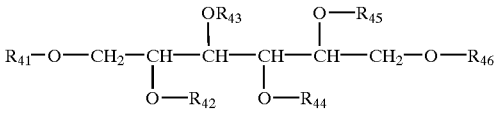

wherein $R_{41}$ through $R_{46}$ are each a hydrogen atom or an alkyl group, alkenyl group, cycloalkyl group, cycloalkenyl group, acyl group, sulfonyl group, phosphonyl group, carbamoyl group or sulfamoyl group, provided that at least two of $R_{41}$ through $R_{46}$ are hydrogen atoms but all of them are not hydrogen atoms at the same time;

formula (V)

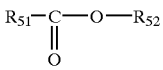

wherein $R_{51}$ is a substituted alkyl or alkenyl group containing at least two hydroxy groups; $R_{52}$ is an alkyl group, alkenyl group, cycloalkyl group or cycloalkenyl group, provided that $R_{51}$ and $R_{52}$ may combine with each other to form a lactone ring;

formula (VI)

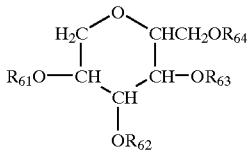

formula (VII)

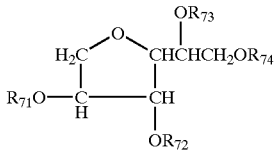

wherein $R_{61}$, $R_{62}$, $R_{63}$, $R_{64}$, $R_{71}$, $R_{72}$, $R_{73}$ and $R_{74}$ are each a hydrogen atom or an alkyl group, alkenyl group, cycloalkyl group, cycloalkenyl group, acyl group, sulfonyl group, phosphonyl group, carbamoyl group or sulfamoyl group, provided that at least two of $R_{61}$, $R_{62}$, $R_{63}$, $R_{64}$, $R_{71}$, $R_{72}$, $R_{73}$ and $R_{74}$ are hydrogen atoms but all of them are not hydrogen atoms at the same time;

formula (VIII)

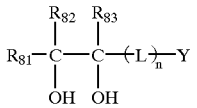

wherein $R_{81}$, $R_{82}$ and $R_{83}$ are each a hydrogen atom or an alkyl group, alkenyl group, cycloalkyl group, cycloalkenyl group, aryl group, or carbamoyl group; L is an alkylene-group or arylenes group; Y is a hydrogen atom, a carbamoyl group, sulfamoyl group or acyl group; n is 0 or 1.

The polyhydric alcohol relating to the invention preferably has total carbon atoms of 6 or more (provided that in the case of formulas (VI) and (VII), total carbon atoms is 10 or more). The polyhydric alcohol preferably has a molecular weight of nor more than 5000 and preferably is in the form of liquid at ordinary temperature. The polyhydric alcohol preferably has a hydroxyl value of 50 or more, and preferably exhibiting a logP value of 3 or more.

Examples of representative polyhydric alcohols relating to the invention include compounds described in JP-A No. 6-166076 at col. [0041 through [0061] but are not limited to these examples.

The organic gelling agent used in the invention is preferably a compound represented by the following formula (1) or (2):

formula (1)

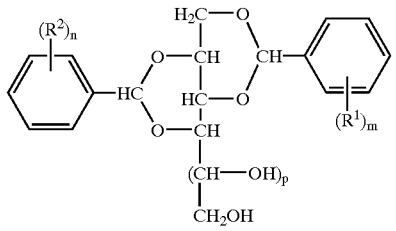

wherein $R^1$ and $R^2$, which may the same or different, are a hydrogen atom, an alkyl group having 1 to 4 carbon atoms, an alkoxy group having 1 to 4 carbon atoms or a halogen atom; m and n are each an integer of 1 to 5; p is 0 or 1, with proviso that when m is 2, two $R^1$s may combine with each other to form a tetralin ring together with a benzene ring linked with the $R^1$s, and that when n is 2, two $R^2$s may combine with each other to form a tetralin ring together with a benzene ring linked with the $R^2$s;

formula (2)

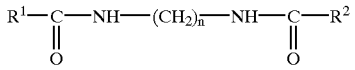

wherein $R^1$ and $R^2$, which may be the same or different, are 12-hydroxyoctadecyl or 12-hydroxyoctadecenyl; and n is an integer of 2 to 12.

In formula (1), $R^1$ and $R^2$, which may the same or different, is a hydrogen atom, an alkyl group having 1 to 4 carbon atoms such as methyl, ethyl, n-propylm isopropyl or butyl, an alkoxy group having 1 to 4 carbon atoms, such as methoxy, ethoxy, n-proyloxy, or a halogen atom such as chlorine or bromine; two $R^1$s or two $R^2$S may combine with each other to form a tetralin ring together with a benzene ring linked with them, such as tetrahydronaphthylidene group.

The compound represented by formula (1) can be prepared employing methods commonly known in the art. Thus, in accordance with a conventional method (as described, for example, in JP-B Nos. 48-43748 and 58-22157, in which the term, JP-B means published Japanese Patent), an aromatic aldehyde and a polyhydric alcohol, i.e., penta-ol or more higher polyol, such as sorbitol or xylitol are subjected to dehydration-condensation reaction in the presence of an acid catalyst to obtain a diacetal. After neutralizing the acid catalyst, the reaction product is washed with water and dried to obtain a compound of formula (1). The dehydration-condensation reaction is preferably carried out in organic solvents as a reaction solvent such as cyclohexane or saturated hydrocarbons, benzene, or cyclohexane or benzene containing one to three alkyl groups having 1 to 4 carbon atoms, in the concurrent presence of a polar solvent such as a lower (e.g., $C_1$ to $C_4$) alcohol (e.g., methanol), dimethylformamide (DMF), dimethylacetoamide (DMAc), dimethylsulfoxide (DMSO), or N-methylpyrrolidone (NMP). Alkali used for neutralization of the acid catalyst is not specifically limited, including, for example, alkali metal hydroxide such as sodium hydroxide, potassium hydroxide or lithium hydroxide; alkaline earth metal hydroxide such as calcium hydroxide or magnesium hydroxide; alkali metal carbonates, alkaline earth metal carbonates and alkaline earth metal hydrogen carbonates.

Examples of the compound represented by formula (1) include 1,3,2,4-O-bis-(sym-diacetal) compounds such as 1,3,2,4-O-bis-dibenzylidenesorbitol, 1,3,2,4-O-bis-(4-methylbenzylidene)sorbitol, 1,3,2,4-O-bis-(4-ethylibenzylidene)sorbitol, 1,3,2,4-O-bis-(4-isopropylbenzylidene)sorbitol, 1,3,2,4-O-bis-(2,4-dimethylbenzylidene)sorbitol, 1,3,2,4-O-bis-(3,4-dimethylbenzylidene)sorbitol, 1,3,2,4-O-bis-(3,5-dimethylbenzylidene)sorbitol, 1,3,2,4-O-bis-(3,4-dimethylbenzylidene)sorbitol, 1,3,2,4-O-bis-(2,4,5-trimethylbenzylidene)sorbitol, 1,3,2,4-O-bis- (3,4,5-trimethylbenzylidene)sorbitol, 1,3,2,4-O-bis-(4-methoxybenzylidene)sorbitol, 1,3,2,4-O-bis-(4-chlorolbenzylidene) sorbitol, and 1,3,2,4-O-bis-(tertrahydrolbenzylidene) sorbitol; and asymmetric acetal compounds such as 1,3-O-benzylidene-2,4-O-(3,4-dimethylbenzylidene)sorbitol, 1,3-O-(3,4-dimethylbenzylidene)-2,4-O-benzylidenesorbitol, 1,3-O-benzylidene-2,4-O- (2,4-dimethylbenzylidene)sorbitol, and 1,3-O-(2,4-dimethylbenzylidene)-2,4-O-benzylidenesorbitol. Of these, bis-O-(3,4-dimethylbenzylidene)sorbitol, bis-o-(2,4-dimethylbenzylidene)sorbitol, bis-O-(4-methylbenzylidene)sorbitol, bis-O-(4-ethylbenzylidene)sorbitol, bis-O-(4-chlorobenzylidene)sorbitol, bis-O-(2,4,5-trimethylbenzylidene)sorbitol and bis-O-(tetrahydronaphthylidene)sorbitol. These compounds may be used alone or in combination.

Next, bisamide compounds represented by formula (2) will be described. In formula (2), $R^1$ and $R^2$ are each 12-hydroxyoctadecyl or 12-hydroxyoctadecenyl, which may be the same or different; and n is an integer of 2 to 12.

The compound of formula (2) can be obtained substantially quatitatively by causing one or more compounds selected from 12-hydroxyoctadecanoic acid, 12-hydroxyoctadecenic acid and their methyl esters, and a diamine corresponding to the intended bisamide to condensate in the absence of or in the presence of a catalyst at a temperature lower than 250° C. The diamine used to obtain the compound of formula (2) is an alkylenediamine having 2 to 12 carbon atoms, preferably ethylenediamine, trimetylenediamine, tetramethylenediamine, hexamethylenediamine and dodecamethylenediamine. The foregoing catalysts optionally used in the preparation of compounds of formula (2) include, for example, alkali alcoholate such as sodium methylate, sodium hydroxide, potassium hydroxide, aluminum hydroxide, alkyl titanate, paratoluenesulfonic acid, and sulfuric acid.

The compounds represented by formula (2) are characterized in that they exhibit a relatively low melting point of not more than 150° C. and are superior gelling agent soluble at a relatively low temperature. The addition amount of the compound of formula (2) is optimally selected taking into account of the kind of objective material and processing conditions, and usually 0.05 to 30%, and 0.2 to 10% by weight, based on material to be gelled. Representative examples of the compound of formula (2) include ethylenebis (12-hydroxyoctadecanoic acid) amide, 12-hydroxyoctadecanoic acid type bisamide (n=2), 12-hydroxyoctadecanoic acid type bisamide (n=4), 12-hydroxyoctadecanoic acid type bisamide (n=6), 12-hydroxyoctadecanoic acid type bisamides (n=8), 12-hydroxyoctadecenoic acid type bisamide (n=2), 12-hydroxyoctadecenoic acid type bisamide (n=4), 12-hydroxyoctadecenoic acid type bisamide (n=6), and 12-hydroxyoctadecenoic acid type bisamides (n=8).

Cross-Linking Agent

Although it is commonly known that the use of a crosslinking agent in such a binder as described above improves layer adhesion and lessens unevenness in development, the use of the crosslinking agent is also effective in fog inhibition during storage and prevention of print-out after development.

Crosslinking agents usable in the invention include various commonly known crosslinking agents used for photographic materials, such as aldehyde type, epoxy type, vinylsulfon type, sulfonester type, acryloyl type, carbodiimide type crosslinking agents, as described in JP-A 50-96216. Of these, compounds capable of reacting with a hydroxy group, i.e., hydroxy group-reactive compounds are preferably employed. Specifically preferred are an isocyanate type compound, epoxy compound and acid anhydride, as shown below. One of the preferred crosslinking agents is an isocyanate or thioisicyanate compound represented by the following formula:

$$X{=}C{=}N{-}L{-}(N{=}C{=}X)v \qquad \text{formula (8)}$$

wherein v is 1 or 2; L is a bivalent linkage group having an alkylene, alkenylene, arylene or alkylarylene group; and X is an oxygen atom or a sulfur atom. An arylene ring of the arylene group may be substituted. Preferred substituents include a halogen atom (e.g., bromine atom, chlorine atom), hydroxy, amino, carboxy, alkyl and alkoxy.

The isocyanate crosslinking agent is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples include isocyanate compounds described in JP-A 56-5535 at pages 10-12.

Specifically, adduct of isocyanate and polyhydric alcohol improves adhesion between layers, exhibiting high capability of preventing layer peeling, image slippage or production of bubbles. These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus it may be incorporated into one or plurality of these layers.

The thioisocyanate type crosslinking agent usable in the invention is to be a compound having a thioisocyanate structure, corresponding to the isocyanates described above.

The crosslinking agents described above are used preferably in an amount of 0.001 to 2 mol, and more preferably 0.005 to 0.5 mol per mol of silver.

The isocyanate compounds and thioisocyanate compounds used in the invention are preferably those which are capable of functioning as a hardener. Even when "v" of formula (8) is zero, i.e., even a compound containing only one functional group provides favorable effects.

Examples of silane compounds used as a crosslinking agent include the compounds described in Japanese Patent Application No. 2000-77904, represented by the following formula (1) or (2):

$$(R^1O)_m{-}Si{-}(L_1{-}R^2)_n \qquad \text{formula (1)}$$

formula (2)

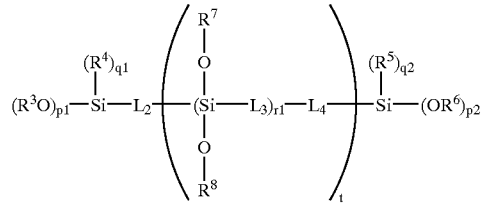

wherein $R^1$, $R^2$, $R^3$, $R^4$, $R^5$ $R^6$, $R^7$ and $R^8$ represent each an alkyl group, an alkenyl group, an alkynyl group, an aryl group or a heterocyclic group; $L_1$, $L_2$, $L_3$ and $L_4$ represent each a bivalent linkage group; m and n are each an integer of 1 to 3, provided that m+n is 4; p1 and p2 are each an integer of 1 to 3 and q1 and q2 are each 0, 1 or 2, provided that p1+q1 and p2+q2 are each 3; r1 and r2 are each 0 or an integer of 1 to 1000; and x is 0 or 1.

In the formulas, $R^1$, $R^2$, $R^3$, $R^4$, $R^5$, $R^6$, $R^7$ and $R^8$ re each a straight chain, branched or cyclic alkyl group having 1 to 30 carbon atoms (e.g., methyl, ethyl, butyl, octyl, dodecyl, cycloalkyl, alkenyl group (e.g., propenyl, butenyl, nonanyl), an alkynyl group (e.g., acetylene group, bisacetylene group, phenylacetylene group), an aryl group (e.g., phenyl, naphthyl) or a heterocyclic group (e.g., tetrahydropyran, pyridyl group, furyl, thiophenyl, imidazolyl, thiazolyl, thiazolyl, oxadiazolyl). These groups may be substituted and substituent groups include any one of electron-withdrawing and electron-donating groups. $L_1$, $L_2$, $L_3$ and $L_4$ are each a bivalent linkage group, including an alkylene group (e.g., ethylene, propylene, butylenes, hexamethylene), oxyalkylene group (e.g., oxyethylene, oxypropylene, oxybutylene, oxyhexamethylene, or group comprised of plural these repeating units), aminoalkylene group (e.g., aminoethylene, aminopropylene, aminohexamethylene, or a group comprised of plural these repeating units), and carboxyalkylene group (e.g., carboxyethylene, carboxypropylene, carboxybutylene), thioether group, oxyether group, sulfonamido group and carbamoyl group. At least one substituent group selected from $R^1$, $R_2$, $R^3$, $R^4$, $R^5$, $R^6$, $R^7$ and $R^8$ preferably is a ballast group (or a diffusion-proof group) or an adsorption-promoting group, and more preferably, $R^2$ is a ballast group or an adsorption-promoting group.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular weight (Mn) thereof is preferably 2,000 to 20,000. The epoxy compound used in the invention is preferably a compound represented by the following formula (9):

Formula (9)

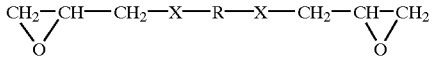

wherein an alkylene group represented by R in formula (9) may be substituted by a substituent selected from a halogen atom, a hydroxyalkyl group and an amino group; R in formula (9) preferably contains an amide linkage, ether linkage or thioether linkage; a bivalent linkage group represented by X is preferably —$SO_2$—, —$SO_2NH$—, —S—, —O— or —NR'—, in which R' is a univalent linkage group and preferably an electron-withdrawing group.

The epoxy compounds may be used alone or combination thereof. The amount to be added is not specifically limited, but preferably $1\times10^{-6}$ to $1\times10^{-2}$ mol/$m^2$, and more preferably $1\times10^{-5}$ to $1\times10^{-3}$ mol/$m^2$. The epoxy compound may be added to any layer of a photosensitive layer, surface protective layer, interlayer, antihalation layer and subbing layer provided on the photosensitive layer-side of the support and may be added to one or plurality of these layers. Further, it may be added to a layer provided on the opposite side of the support, in combination with the photosensitive layer-side. In the case of a photothermographic material having photosensitive layers on both sides of the support, it may be added to any one of the layers.

The acid anhydride used in the invention is preferably a compound containing at least an acid anhydride group represented as below:

—CO—O—CO—

The acid anhydride usable in the invention may be any compound containing one or more acid anhydride group, the number of the acid anhydride group, molecular weight or other parameters are not specifically limited, and a compound represented by the following formula [B] is preferred:

Formula [B]

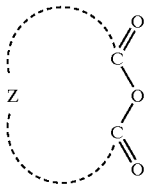

wherein Z is an atomic group necessary to form a monocyclic or polycyclic ring, which may be substituted.

The acid anhydride compound may be used alone or combination thereof. The amount to be added is not specifically limited, but preferably $1\times10^{-6}$ to $1\times10^{-1}$ mol/$m^2$, and more preferably $1\times10^{-4}$ to $1\times10^{-2}$ mol/$m^2$. The acid anhydride compound may be added to any layer of a photosensitive layer, surface protective layer, interlayer, antihalation layer and subbing layer provided on the photosensitive layer-side of the support and may be added to one or plurality of these layers. Further, it may be added to a layer containing the foregoing epoxy compound.

Toning Agent

Photothermographic imaging materials of the invention, which form photographic images on thermal development, comprises a reducible silver source (such as organic silver salts), light sensitive silver halide grains, a reducing agent, and optionally a color toning agent for modifying silver image color tone, which are contained in the form of a dispersion in a binder matrix. Exemplary preferred toning agents are described in RD17029, U.S. Pat. Nos. 4,123,282, 3,994,732, 3,846,136 and, 4,021,249. Examples thereof include imides (succinimide, phthalimide, naphthalimide, N-hydroxy-1,8-naphthalimide, etc.); mercaptanes (e.g., 3-mercapto-1,2,4-triazole, etc.); phthalazinone derivatives and their metal salt [e.g., phthalazinone, 4-(1-naphthyl) phthalazinone, 6-chlorophthalazinone, 5,7-dimethyloxyphthalazinone, 2,3-dihydroxy-1,4-phthalzinedione, etc.]; combinations of phthalazine and phthalic acids (e.g., phthalic acid, 4-methylphthalic acid, 4-nitrophthalic acid, tetrachlorophthalic acid, etc.); and combinations of phthalazine and at least one selected from maleic acid anhydride, phthalic acid, 2,3,-naphthalenedicarboxylic acid, and o-phenyleneacid derivatives and their anhydrides (e.g., phthalic acid, 4-methyphthalic acid, 4-nitrophthalic acid, tetrachlorophthalic acid, etc.). Specifically preferred toning agents include phthalazinone, a combination of phthalazine, and phthalic acids or phthalic acid anhydrides.

Matting Agent

In the present invention, a matting agent is preferably incorporated into the surface layer of the photothermographic imaging material (on the light sensitive layer side or even in cases where a light insensitive layer is provided on the opposite side of the support to the light sensitive layer). In order to minimize the image abrasion after thermal development, the matting agent is provided on the surface of a photosensitive material and the matting agent is preferably incorporated in an amount of 1 to 30% by weight of the binder.

Materials of the matting agent employed in the invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Pat. No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The matting agent used in the invention preferably has an average particle diameter of 0.5 to 10 $\mu$m, and more preferably of 1.0 to 8.0 $\mu$m. Furthermore, the variation coefficient of the size distribution is preferably not more than 50%, is more preferably not more than 40%, and is still more preferably not more than 30%. The variation coefficient of the grain size distribution as described herein is is a value represented by the following formula:

$$(\text{standard deviation of particle size}/\text{average particle size})\times 100.$$

Addition methods of the matting agent include those in which a matting agent is previously dispersed into a coating composition and is then coated, and prior to the completion of drying, a matting agent is sprayed. When plural matting agents are added, both methods may be employed in combination.

Residual Solvent Content

It is preferred that when subjected to thermal development, the photothermographic imaging material contains an organic solvent of 5 to 100-mg/m$^2$. The organic solvent content is more preferably 100 to 500 mg/m$^2$. The solvent content within the range described above leads to a thermally developable photosensitive material with low fog density as well as high sensitivity. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These solvents may be used alone or in combination.

The solvent content in the photothermographic material can be adjusted by varying conditions such as temperature conditions at the drying stage, following the coating stage. The solvent content can be determined by means of gas chromatography under conditions suitable for detecting the solvent.

Support

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 $\mu$m, and preferably 70 to 180 $\mu$m.

To improve electrification properties of photothermographic imaging materials relating to the invention, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14–20.

Filter Dye, Infrared-Absorbing Dye

It is preferred to form a filter layer on the same side as or on the opposite side to the light sensitive layer or to allow a dye or pigment to be contained in the light sensitive layer to control the amount of wavelength distribution of light transmitted through the light sensitive layer of photothermographic imaging materials relating to the invention. Commonly known compounds having absorptions in various wavelength regions can used as a dye, in response to spectral sensitivity of the photothermographic material.

In cases where the photothermographic imaging material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium. The compound containing a squarilium nucleus is a compound having a 1-cyclobutene-2-hydroxy-4one in the molecular structure and the compound containing chroconium nucleus is a compound having a 1-cyclopentene-2-hydroxy,4,5-dione in the molecular structure, in which the hydroxy group may be dissociated. Hereinafter, these dyes are collectively called a squarilium dye.

Compounds described in JP-A 8-201959 are also preferably usable as a dye.

Thermal Processing

The developing conditions for photographic materials are variable, depending on the instruments or apparatuses used, or the applied means and typically accompany heating the imagewise exposed photothermographic imaging material at an optimal high temperature. Latent images formed upon exposure are developed by heating the photothermographic material at an intermediate high temperature (ca. 80 to 200° C., and preferably 100 to 200° C.) over a period of ample time (generally, ca. 1 sec. to ca. 2 min.). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior.

Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. It is also preferred to conduct thermal processing while transporting, while bringing the protective layer side into contact with a heated roller.

Light Exposure

Exposure of photothermographic imaging materials to light desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In the invention, exposure is preferably conducted by laser scanning exposure and various methods are applicable to its exposure. One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 μm, and more preferably not more than 100 μm. Thus, the smaller spot diameter preferably reduces the angle displaced from verticality of the laser incident angle. The lower limit of the beam spot diameter is 10 μm. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the invention, it is preferred to form images by scanning exposure using at least two laser beams. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten μm in the sub-scanning direction on the image surface; and the pitch of the two beams in the sub-scanning direction is 63.5 μm at a printing density of 400 dpi and 42.3 μm at 600 dpi (in which the printing density is represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe.

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 600 to 1200 nm are preferred in terms of maintenance and the size of the light source.

Hue Angle

In the invention, the photothermographic material preferably meets the requirement of $190° < h_{ab} < 260°$, in which $h_{ab}$ is a hue angle (as defined in JIS-Z 8729).

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

The expression regarding to the tone, i.e., "colder tone" or "warmer tone can be determined based on a hue angle, $h_{ab}$ at a density of 1.0, as defined in JIS Z 8729. The hue angle, $h_{ab}$ can be represented as $h_{ab}=\tan^{-1}(b^*/a^*)$ obtained from a XYZ color system, or tristimulus values X, Y and Z or $X_{10}$, $Y_{10}$ and $Z_{10}$ defined in JIS Z 8701, using color coordinates a* and b* in L*a*b* color system defined in JIS Z 8729. In the invention the range of the hab is preferably $195° < h_{ab} < 255°$, and more preferably $200° < h_{ab} < 250°$. The hue angle within this range results in enhanced recognition at relatively low density areas.

EXAMPLES

The present invention will be further described based on examples but embodiments of the invention are by no means limited to these examples.

Example 1

Preparation of Photographic Support

On one side of blue-tinted polyethylene terephthalate film (having a thickness of 175 μm) exhibiting a density of 0.170 which was previously subjected to a corona discharge treatment at 0.5 kV·A·min/m$^2$, sublayer A was coated using the following sublayer coating solution A-1 so as to have a dry layer thickness of 0.2 μm. After the other side of the film was also subjected to a corona discharge treatment at 0.5 kV·A·min/m$^2$, sublayers B and A were coated thereon using sublayer coating solutions B and A described below so as to have dry layer thickness of 0.1 and 0.2 $\mu$m, respectively. Thereafter, a heating treatment was conducted at 130° C. for 15 min in a heating treatment type oven having a film transport apparatus provided with plural rolls.

Sub-Coating solution A

Copolymer latex solution (30% solids) of 270 g, comprised of 30% by weight of n-butyl acrylate, 20% by weight of t-butyl acrylate, 25% by weight of styrene and 25% by weight of 2-hydroxyethyl acrylate was mixed with 0.6 g of compound (UL-1) and 1 g of methyl cellulose. Further thereto a dispersion in which 1.3 g of silica particles (SILOID, available from FUJI SYLYSIA Co.) was previously dispersed in 100 g of water by a ultrasonic dispersing machine, Ultrasonic Generator (available from ALEX Corp.) at a frequency of 25 kHz and 600 W for 30 min., was added and finally water was added to make 100 ml to form sub-coating solution A.

Preparation of Colloidal Tin Oxide Dispersion

Stannic chloride hydrate of 65 g was dissolved in 2000 ml of water/ethanol solution. The prepared solution was boiled to obtain co-precipitates. The purified precipitate was taken out by decantation and washed a few times with distilled water. To the water used for washing, aqueous silver nitrate was added to confirm the presence of chloride ions. After confirming no chloride ion, distilled water was further added to the washed precipitate to make the total amount of 2000 ml. After adding 40 ml of 30% ammonia water was added and heated, heating was further continued and concentrated to 470 ml to obtain a colloidal tin oxide dispersion.

Sub-Coating solution B

The foregoing colloidal tin oxide dispersion of 37.5 g was mixed with 3.7 g of copolymer latex solution (30% solids) comprised of 20% by weight of n-butyl acrylate, 30% by weight of t-butyl acrylate, 27% by weight of styrene and 28% by weight of 2-hydroxyethyl acrylate, 14.8 g of copolymer latex solution (30% solids) comprised of 40% by weight of nobutyl acrylate, 20% by weight of styrene and 40% by weight of glycidyl methacrylate, and 0.1 g of surfactant UL-1 (as a coating aid) and water was further added to make 1000 ml to obtain sub-coating solution B.

UL-1

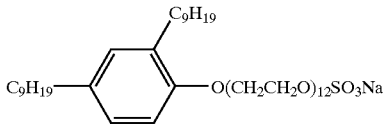

Back Layer-Side Coating

Back layer Coating solution

To 800 g of methyl ethyl ketone, 4.5 g of polyester resin (Vitel PE2200B1 available from Bostic Corp.) and 84 g of cellulose acetate-butyrate (CAB381-20, available from Eastman Chemical Co.) were added and dissolved. To the resulting solution were added 4.4 g fluorinated surfactant FS-1 and 1.79 g fluorinated surfactant (EF-105, available from TOCHEM PRODUCT Co.) were further added with sufficiently stirring until being dissolved. To the resulting solution was added 57 g of silica particles (SYLOID, available from FUJI SYLYSIA Co.), which were previously added to methyl ethyl ketone in a concentration of 2% by weight and dispersed for a period of 45 min. in a dissolver mill (DISPERMAT Type CA-40M, available from VMA-Getzman Co.). Further thereto, 0.18 g of infrared sensitizing dye-1 and 0.84 g of HA-1 (Desmodur N3300) were added methyl ethyl ketone was further added to make a total weight of 1000 g.

The thus prepared coating solutions were each coated on the support using an extrusion coater and dries so as to form a dry layer of 3.5 $\mu$m. Drying was conducted at a dry bulb temperature of 100° C. and a dew point of 10° C. over a period of 5 min.

Infrared sensitizing dye-1

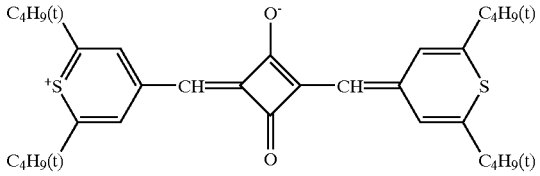

FS-1

$C_9H_{17}$—$O(CH_2CH_2O)_{22}$—$C_9F_{17}$

HA-1

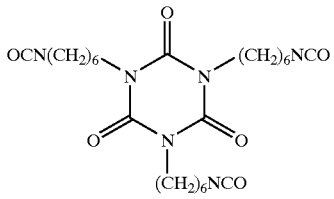

(Desmodur N3300, isocyanate compound)

Emulsion Layer-Side Coating

Preparation of Light-Sensitive Silver Halide Emulsion

| | |
|---|---|
| Solution A1 | |
| Phenylcarbamoyl gelatin | 88.3 g |
| Compound A* (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |
| Solution E1 | |
| 0.4 mol/l aqueous potassium bromide solution Amount necessary to adjust silver potential | |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |

Compound (A) $HO(CH_2CH_2O)_n—(CH(CH_3)CH_2O)_{17}—CH_2CH_2O)_mH$ (m+n=5 to 7)

Using a stirring mixer described in JP-B Nos. 58-58288, ¼ of solution B1, the total amount of solution Cl were added to solution A1 by the double jet addition for 4 min 45 sec. to form nucleus grain, while maintaining a temperature of 45° C. and a pAg of 8.09. After 1 min., the total amount of solution F1 was added thereto, while the pAg was adjusted using solution E1. After 6 min, 3/4 of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 liters water with stirring, the silver halide emulsion was again coagulated. Remaining 1500 ml of precipitates, the supernatant was removed and after adding 10 liters water with stirring, the silver halide emulsion was again coagulated. Remaining 1500 ml of precipitates, the supernatant was removed and solution Hl was added. The temperature was raised to 60° c and stirring continued for 120 min. Finally, the pH was adjusted to 5.8 and water was added there to so that the weight per mol of silver was 1161 g, and light-sensitive silver halide emulsion B-3 was thus obtained.

It was proved that the resulting emulsion was comprised of monodisperse silver iodobromide cubic grains having an average grain size of 0.058 μm, a coefficient of variation of grain size of 12% and a [100] face ratio of 92%.

The amount of iridium contained in silver halide grains was $8.2\times10^{-6}$ mol per mol of silver, the amount of iridium not contained in silver halide grains was $1.6\times10^{-6}$ mol per mol of silver, and the amount of gelatin contained in the silver halide emulsion was 42.5 g per mol of silver.

Preparation of Powdery Organic Silver Salt

Behenic acid of 130.8 g, arachidic acid of 67.7 g stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion B-3 obtained above and 450 ml of water were added and stirred for 5 min., while being maintained at 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm. Using a flush jet dryer (produced by Seishin Kigyo Co., Ltd.), the thus obtained cake-like organic silver salt was dried under an atmosphere of nitrogen gas, according to the operation condition of a hot air temperature at the inlet of the dryer until reached a moisture content of 0.1% to obtain dried powdery organic silver salt A. The moisture content was measured by an infrared ray aquameter.

Preparation of Light-sensitive Emulsion A

In 1457 g MEK was dissolved 14.57 g of polyvinyl butyral powder (ESLEK BL-5, available from Sekisui Kagaku Kogyo Co., Ltd.) and further thereto was gradually added 500 g of the powdery organic silver salt B-3 to obtain pre-dispersion B-3, while stirring by a dissolver type homogenizer (DISPERMAT Type CA-40, available from VMA-GETZMANN). Thereafter, using a pump, the pre-dispersion A was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 13 m/s and for 10 min. of a retention time with a mill to obtain light-sensitive emulsion A.

Preparation of Stabilizer Solution

In 4.97 g methanol were dissolved 1.0 g of Stabilizer 1 and 0.31 g of potassium acetate to obtain stabilizer solution.

Preparation of Infrared Sensitizing Dye Solution A

In 31.3 ml MEK were dissolved 19.2 mg of infrared sensitizing dye 1, 1.488 g of 2-chlorobenzoic acid, 2.779 g of Stabilizer-2 and 365 mg of 5-methyl-2-mercaptobenzimidazole in a dark room to obtain an infrared sensitizing dye solution A.

Preparation of Additive Solution a

In 110 g MEK were dissolved 27.98 g of developer 1,1-bis(2-hydroxy-3,5-dimethylphenyl)-2-methylpropane, 1.54 g of 4-methylphthalic acid and 0.48 g of the infrared dye-1 to obtain additive solution a.

Preparation of Additive Solution b

Antifoggants-1 and -2, each of 1.78 g were dissolved in 40.9 g MEK to obtain additive solution b.

Infrared sensitizing dye 1

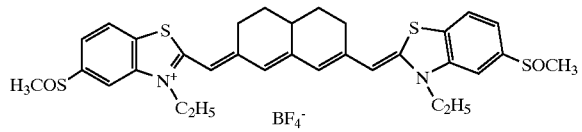

Stabilizer 1

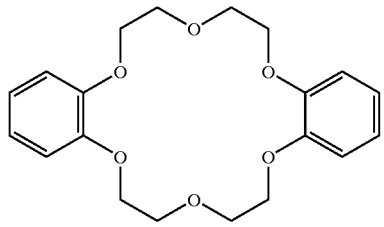

Stabilizer 2

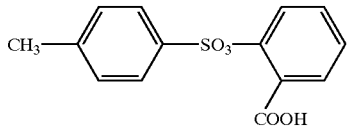

Developer 1

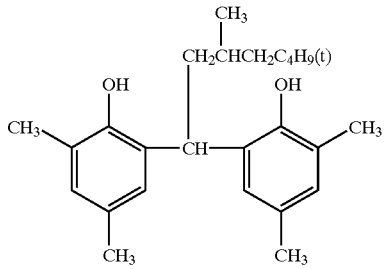

Antifoggant 1

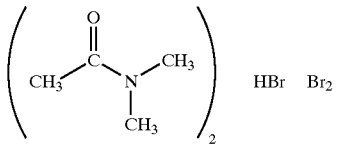

-continued

Antifoggant 2

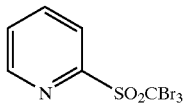

Preparation of Light-Sensitive Layer Coating Solution A

Under inert gas atmosphere (97% nitrogen), 50 g of the light-sensitive emulsion A and 15.11 g MEK were maintained at 21° C. with stirring, and after 2 min., 390 μm of antifoggant-2 (10% methanol solution) was added and stirred for 1 hr. Further thereto, 494 μl of calcium bromide (10% methanol solution) was added and stirred for 20 min. Subsequently, 167 ml of the stabilizer solution was added and after stirring for 10 min., 2.622 g of infrared sensitizing dye solution A was added and stirred for 1 hr. Then, the mixture was cooled to 13° C. and stirred for 30 min. Further thereto, 13.31 g of polyvinyl butyral (Comparative-1: B-79, available from SORCIA Co.) was added and stirred for 30 min, while maintaining the temperature at 13° C., and 1.084 g of tetrachlorophthalic acid (9.4% MEK solution) and stirred for 15 min. Then, 12.43 g of additive solution a, 1.6 ml of 10% MEK solution of Desmodur N3300 (aliphatic isocyanate, available from Movey Co.) and 4.27 g of additive solution b were successively added with stirring to obtain coating solution A of the light-sensitive layer.

Preparation of Surface Protective Layer Coating Solution

There was prepared a surface protective layer coating solution having the following composition.

Fine Particle Dispersing Solution

To 96 g of methyl ethyl ketone, 1 g of cellulose acetate-butyrate (CAB171-15, available from Eastman Chemical Co.) was added with stirring and stirring further continued by a dissolver type stirrer until being completely dissolved. Further thereto, 2.9 g of Silica particles (SYLOID 320 available from FUJI SYLYSIA Co.) was added and stirred at 8000 rpm for 45 min., using DISPERMAT Type CA-40M (dissolver mill, available from VMA-GETZMANN).

Surface Protective Layer Coating Solution

To 750 g of methyl ethyl ketone, 15 g of polymethyl methacrylate (Paraloid A-21, available from Rohm & Haas Corp.) was added stirred for 10 min. Then, 100 g of cellulose acetate-butyrate (CAB171-15, available from Eastman Chemical Co.) was divided into four portions, each of them was separately added and stirred for 1 hr. Further thereto, 8.9 g of phthalazine, 1.5 g of 1,3- vinylsilfon compound (HD-1), 0.1 g of triazine, 1.7 g of fluorinated surfactant (FS-1) and 0.2 g of fluorinated surfactant (EF-105, available from TOCHEM PRODUCT Co.) were added and dissolved for 30 min. Further thereto, the foregoing dispersing solution of 85 g was added with stirring. Finally, methyl ethyl ketone was added to make a total amount of 1000 g to obtain surface protective coating solution.

Vinylsulfon compound (HD-1)

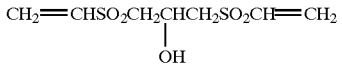

Preparation of Photothermographic Material

Preparation of Sample 101

Using a commonly known extrusion type coater, the thus prepared light-sensitive layer coating solution A and protective layer coating solution were simultaneously coated on the support having coated on the back side in the order of the light-sensitive layer and protective layer to prepare sample 101. The silver coating amount of the light-sensitive layer was 2.0 g/m$^2$ and the dry layer thickness of the protective layer was 2.5 μm. Drying was conducted using hot air at a dry bulb temperature of 50° C. and a dew point of 10° C. for 10 min.

Samples 102 through 110 were prepared similarly to sample 101, except that polyvinyl butyral resin (Comparative-1: B-79, available from Solsia Co.) as a binder, contained in the light-sensitive layer coating solution A was replaced by binders or organic gelling agents shown in Table 2. In Table 2, "OG-2" represents ethylenebis(12-hydroxyoctadecanoic acid)amide.

OG-1

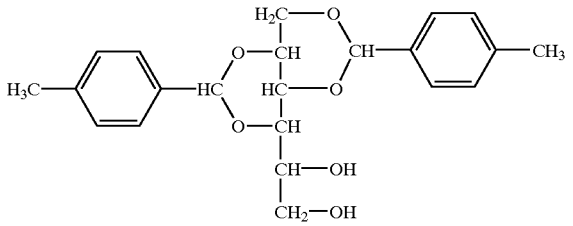

Evaluation of Photothermographic Material

Sensitometry

The thus prepared samples 101 through 110 were allowed to stand in an atmosphere at 25° C. and 55% RH for a period of 10 days, then, stepwise exposed by decreasing the exposure amount by 0.05 of log E from the maximum output, using Dry Pro 722 (available from Konica Corp.) at room temperature, and processed at a developing temperature of 123° C. for a processing time of 13.5 sec. The thus thermally developed samples were each subjected to densitometry using a transmission densitometer, PDM 65 (available from Konica Corp.). The densitometry results were processed in a computer to prepare a characteristic curve comprised of density (ordinate) and logarithmic exposure (abscissa). In the invention, sensitivity was represented by a relative value of the reciprocal of exposure necessary to give an opotical density of 1.0 above the minimum density (Dmin or fog density), based on the sensitivity of sample 101 being 100.

Determination of Variation in Fog Density

Samples which were thermally processed similarly to the foregoing sensitometry were continuously exposed to light in an atmosphere at 45° C. and 55% RH for 24 hrs., in which a light source of F-7 of CIE was arranged so as to transmit through a white diffusion plate (acrylic resin) having a total light transmittance of 58%, a reflectance of 40% and a dif fusivity of 84% and exhibit an illumination intensity of 300 lux on the surface of each sample. Thereafter, exposed and unexposed samples were measured for the minimum density, and rate of variation in fog density was determined in accordance with the following equation 1:

$$\text{Rate of variation in fog density} = (D_{fog2} - D_{fog1}) / D_{fog1} \times 100\ (\%) \qquad \text{Equation 1}$$

wherein $D_{fog1}$ represents the minimum density of a sample unexposed to light and $D_{fog2}$ represents the minimum density of a sample exposed to the foregoing light.

Thermal Transition Point

Each of the foregoing light-sensitive layer coating solution and protective layer coating solution for samples 101 to 110 were respectively coated on a Teflon plate using a wire-bar and dried under the same condition. The thus coated samples were exposed under conditions giving the maximum density and were then thermally developed.

Thereafter, the constitution layer coated onto the Teflon plate was peeled from the plate. The thus peeled sample of 10 mg was charged into an aluminum pan and the thermal transition point for each sample was determined using a differential scanning calorimeter (EXSTAR 6000, available from SEIKO DENSHIKCGYO Co., Ltd.), in accordance with JIS K7121. In the measurement, the temperature was raised at a rate of 10° C./min within the range of 0 to 200° C. and then, the temperature was lowered to 0° C. at a rate of 20° C./min. This procedure was repeated twice to determine the thermal transition point.

Evaluation of Image Lasting Quality

Thermally developed samples were prepared similarly to the determination of variation in fog density. After being allowed to stand under the environment of 25° C. or 45° C. for 3 days, maximum densities after being allowed to stand were measured and variation in image density was determined as a measure of image lasting quality, in accordance with the following equation:

Variation in image density=(maximum density of sample aged at 45° C.)/(maximum density of sample aged at 25° C.)×100 (%) Equation 2

Evaluation of Storage Stability

Unexposed samples were allowed to stand for 10 days under two different conditions, A and B, as described below. The thus aged samples were exposed and thermally developed to determine sensitivity in the same manner as in the foregoing sensitometry. Variation in sensitivity between conditions A and B was determined as a measure of pre-exposure storage stability, in accordance with the following equation:

Condition A: 25° C., 55% RH

Condition B: 40° C., 80% RH

Variation in sensitivity=(sensitivity at condition B)/(sensitivity at condition A)×100 (%) Equation 3

Evaluation of Abrasion Resistance

Samples were each processed in the same manner as in the foregoing sensitometry and hardness immediately after processing was determined in accordance with the pencil hardness test described in JIS K5200.

The thus obtained results are shown in Table 2.

TABLE 2

| Sample No. | Light-Sensitive Layer Coating Solution A: Binder | Light-Sensitive Layer Coating Solution A: Gelling Agent | Thermal Transition Point (° C.) | Sensitivity | Variation in Fog Density (%) | Image Lasting Quality (%) | Storage Stability (%) | Abrasion Resistance | Remark |
|---|---|---|---|---|---|---|---|---|---|
| 101 | Comp.-1 | — | 43 | 100 | 54 | 78 | 84 | B | Comp. |
| 102 | Comp.-2 | — | 45 | 101 | 37 | 82 | 88 | B | Comp. |
| 103 | P-1 | — | 51 | 102 | 24 | 97 | 97 | HB | Inv. |
| 104 | P-4 | — | 52 | 100 | 24 | 98 | 98 | HB | Inv. |
| 105 | P-3 | — | 55 | 103 | 23 | 98 | 99 | HB | Inv. |
| 106 | Comp.-1 | OG-1 | 48 | 102 | 25 | 88 | 92 | HB | Inv. |
| 107 | Comp.-2 | OG-2 | 57 | 101 | 23 | 91 | 94 | HB | Inv. |
| 108 | P-2 | OG-1 | 54 | 102 | 18 | 99 | 97 | H | Inv. |
| 109 | P-5 | OG-1 | 57 | 101 | 17 | 98 | 98 | HB | Inv. |
| 110 | P-2 | OG-2 | 58 | 103 | 19 | 97 | 97 | H | Inv. |

As is apparent from Table 2, it was proved that samples No. 103 through 110 using a binder or organic gelling agent having a thermal transition point relating to the invention exhibited enhanced sensitivity, minimized variation in fog density, and superior image lasting quality and pre-exposure storage stability, compared to sample Nos. 101 and 102. It was further proved that samples No. 103 through 110 also exhibited superior abrasion resistance, as a surface layer characteristic.

Example 2

Preparation of Light-Sensitive Layer Coating Solution B, C

Light-sensitive layer coating solutions B and C were prepared according to the following procedure.

Preparation of Light-Sensitive Layer Coating Solution B

Under inert gas atmosphere (97% nitrogen), 50 g of the light-sensitive emulsion A described earlier and 15.11 g MEK were maintained at 21° C. with stirring, 1000 μl of chemical sensitizer S-5 (0.5% methanol solution) was added thereto and after 2 min., 390 μm of antifoggant-2 (10% methanol solution) was added and stirred for 1 hr. Further thereto, 494 μl of calcium bromide (10% methanol solution) was added and after stirring for 10 min., gold sensitizer Au-5 of 1/20 equimolar amount of the chemical sensitizer was added and stirred for 20 min. Subsequently, 167 ml of the stabilizer solution used in Example 1 was added and after stirring for 10 min., 1.32 g of infrared sensitizing dye solution A used in Example 1 was added and stirred for 1 hr. Then, the mixture was cooled to 13° C. and stirred for 30 min. Further thereto, 13.31 g of polyvinyl butyral (Comp-1, B-79, available from Solcia Co.) was added and stirred for 30 min, while maintaining the temperature at 13° C., and 1.084 g of tetrachlorophthalic acid (9.4% MEK solution) and stirred for 15 min. Then, 12.43 g of additive solution a used in Example 1, 1.6 ml of 10% MEK solution of Desmodur N3300 (aliphatic isocyanate, product by Movey Co.) and 4.27 g of additive solution b used in Example 1 were successively added with stirring to obtain coating solution B of the light-sensitive layer.

Preparation of Light-sensitive Layer Coating Solution C

Under inert gas atmosphere (97% nitrogen), 50 g of the light-sensitive emulsion A and 15.11 g MEK were maintained at 21° C. with stirring, 1000 μl of chemical sensitizer S-5 (10% methanol solution) was added thereto and after 2 min., 390 μm of antifoggant 1 (10% methanol solution) was added and stirred for 1 hr. Further thereto, 494 μm of calcium bromide (10% methanol solution) was added and after stirring for 10 min., gold sensitizer Au-5 of 1/20 equimolar amount of the chemical sensitizer, S-5 was added and stirred for 20 min. Subsequently, 167 ml of the stabilizer solution described above was added and after stirring for 10 min., 1.32 g of the infrared sensitizing dye solution A was added and stirred for 1 hr. Then, the mixture was cooled to 13° C. and stirred for 30 min. Further thereto, 13.31 g of polyvinyl butyral (Comp-1, B-79, available from Solcia Co.) was added and stirred for 30 min, while maintaining the temperature at 13° C., and 1.084 g of tetrachlorophthalic acid (9.4% MEK solution) and stirred for 15 min. Then, 12.43 g of the additive solution a, 1.6 ml of 10% MEK solution of Desmodur N3300 (aliphatic isocyanate, product by Movey Co.), 4.27 g of the additive solution b and 10.0 g of additive solution c, described below were successively added with stirring to obtain coating solution C of the light-sensitive layer.

Preparation of Additive Solution c

Silver-saving agent H-38 of 5.0 g was dissolved in 45.0 g of MEK to obtain additive solution c.

Silver-saving agent H-38

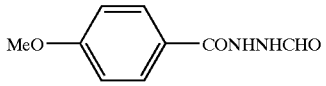

were simultaneously coated on the support having coated on the back side, prepared in Example 1, in the order of the light-sensitive layer C. light-sensitive layer B and protective layer to prepare sample 201. Silver coating amounts of the light-sensitive layers B and C were 0.7 g/m$^2$ and 0.3 g/m$^2$, respectively and the dry layer thickness of the protective layer was 2.5 $\mu$m. Drying was conducted using hot air at a dry bulb temperature of 50° C. and a dew point of 10° C. for 10 min.

Samples 202 through 212 were prepared similarly to sample 201, except that polyvinyl butyral resin (Comparative-1: B-79, available from Solsia Co.) used in the light-sensitive layers B and C was replaced by binders or organic gelling agents shown in Table 3. In samples 211 and 212, 0.12 g of anti-foggant 3 was added to each of the light-sensitive layers.

Anti-foggant 3

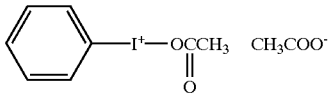

TABLE 3

| | Light-Sensitive Layer Coating Solution B | | | | Light-Sensitive Layer Coating Solution C | | | | |
|---|---|---|---|---|---|---|---|---|---|
| Sample No. | Binder | Gelling Agent (mg/m$^2$) | Hardener | Antifoggant 3 | Binder | Gelling Agent (mg/m$^2$) | Hardener | Antifoggant 3 | Remark |
| 201 | Comp-1 | — | HA-1 | — | Comp-1 | — | HA-1 | — | Comp. |
| 202 | Comp-1 | — | — | — | Comp-1 | — | HA-1 | — | Comp. |
| 203 | Comp-1 | OG-1 (30) | — | — | Comp-1 | — | HA-1 | — | Inv. |
| 204 | P-1 | OG-1 (30) | HA-1 | — | P-1 | OG-1 (30) | HA-1 | — | Inv. |
| 205 | P-1 | — | HA-1 | — | P-1 | — | HA-1 | — | Inv. |
| 206 | P-4 | — | HA-1 | — | P-4 | — | HA-1 | — | Inv. |
| 207 | P-3 | — | HA-1 | — | P-3 | — | HA-1 | — | Inv. |
| 208 | P-1 | OG-1 (30) | — | — | P-1 | — | HA-1 | — | Inv. |
| 209 | P-1 | OG-1 (30) | HA-1 | — | P-1 | — | — | — | Inv. |
| 210 | P-4 | OG-1 (30) | HA-1 | — | P-4 | OG-1 (30) | HA-1 | — | Inv. |
| 211 | P-1 | — | HA-1 | Presence | P-1 | — | HA-1 | Presence | Inv. |
| 212 | P-1 | OG-1 (30) | HA-1 | Presence | P-1 | OG-1 (30) | HA-1 | Presence | Inv. |

-continued

S-5

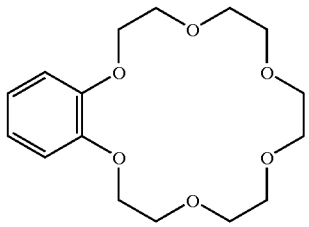

Au-5

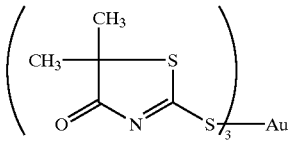

Preparation of Photothermographic Material

Using a commonly known extrusion type coater, the foregoing light-sensitive layer coating solutions B and C, and the protective layer coating solution used in Example 1

Exposure and Processing

Samples were each subjected to laser scanning exposure from the emulsion side using an exposure apparatus having a light source of 800 to 820 nm semiconductor laser of a longitudinal multi-mode, which was made by means of high frequency overlapping. In this case, exposure was conducted at an angle of 70°, between the exposed surface and exposing laser light and as a result, images with superior sharpness were unexpectedly obtained, as compared to exposure at an angle of 90°. Subsequently, using an automatic processor provided with a heated drum, exposed samples were subjected to thermal development at 123° C. for 13.5 sec., while bringing the protective layer surface of the photothermographic material into contact with the drum surface. Exposure and thermal processing were carried out using a modified Dry Pro 722 (available from Konica Corp.). Thermal development was conducted in an atmosphere at 23° C. and 50% RH.

The thus thermally processed samples were evaluated in the following manner.

Evaluation of Photographic Performance

Sensitometry

According to the method described in Example 1, a characteristic curve was prepared to determine sensitivity.

Sensitivity was represented by a relative value, based on the sensitivity of sample 201 being 100.

Image Lasting Quality and Abrasion Resistance

Evaluation was made similarly to Example 1.

Average Gradation (Ga)

The average gradation was defined as the slope of a straight line connecting points corresponding to densities of 0.25 and 2.5 on the characteristic curve.

Hue Angle ($h_{ab}$)

The hue angle ($h_{ab}$) was determined in such a manner that processed samples were measured with respect to areas corresponding to the minimum density (Dmin) and an optical density of 1.0 ($D_{1.}$), using a calorimetric light source, D65 of JIS Z 8720 and a spectral colormeter CM-508d (available from Minolta Co., Ltd.) at a visual field of 2°.

Silver Tone

After being aged under the conditions A and B described in Example 1, samples were subjected to overall exposure giving a density of 1.0 and thermally processed.

The thus processed samples each placed on a viewing box (employing a white fluorescent lamp and a diffusion plate) and visually evaluated through transmission light with respect to silver image tone, based on the following criteria:

5: blue black

4: slightly reddish black,

3: reddish black

2: slightly yellowish black

1: strongly yellowish black, providing uncomfortable feeling to observers, wherein rank 4 or more are levels acceptable for practical use.

Results are shown in Table 4.

TABLE 4

| Sample No. | Thermal Transition Point (° C.) | Sensitivity | Contrast (Ga) | Image Lasting Quality (%) | Abrasion Resistance | Silver Image Tone Condition A | Silver Image Tone Condition B | Hue Angle ($h_{ab}$) Dmin | Hue Angle ($h_{ab}$) $D_{1.0}$ | Remark |
|---|---|---|---|---|---|---|---|---|---|---|
| 201 | 43 | 100 | 2.5 | 78 | B | 4 | 2 | 185 | 265 | Comp. |
| 202 | 41 | 98 | 3.1 | 77 | B | 4 | 2 | 195 | 250 | Comp. |
| 203 | 48 | 104 | 3.3 | 83 | HB | 4 | 4 | 205 | 242 | Inv. |
| 204 | 53 | 100 | 3.4 | 98 | H | 5 | 5 | 206 | 246 | Inv. |
| 205 | 52 | 103 | 3.5 | 98 | H | 5 | 5 | 205 | 246 | Inv. |
| 206 | 51 | 102 | 3.1 | 92 | HB | 5 | 4 | 201 | 240 | Inv. |
| 207 | 57 | 101 | 3.2 | 91 | H | 5 | 5 | 204 | 243 | Inv. |
| 208 | 58 | 102 | 3.1 | 99 | HB | 5 | 5 | 202 | 241 | Inv. |
| 209 | 54 | 101 | 3.1 | 94 | HB | 5 | 5 | 202 | 240 | Inv. |
| 210 | 53 | 103 | 3.1 | 97 | H | 5 | 4 | 201 | 245 | Inv. |
| 211 | 52 | 102 | 3.5 | 97 | H | 5 | 5 | 208 | 248 | Inv. |
| 212 | 53 | 99 | 3.4 | 98 | H | 5 | 5 | 207 | 243 | Inv. |

As apparent from Table 4, it was proved that sample Nos. 203 through 212 using a binder or organic gelling agent having a thermal transition point relating to the invention exhibiting enhanced sensitivity, and superior image lasting quality and abrasion resistance as well as high contrast graduation and minimized variation silver image tone after aging and minimized variation in silver image hue, due to different image densities.

What is claimed is:

1. A photothermographic material comprising on a support a light-sensitive layer comprising an organic silver salt, light-sensitive silver halide grains, a reducing agent and a binder, wherein the photothermographic material exhibits not more than 30% of a rate of variation in fog density defined below:

$$\text{Rate of variation in fog density}=(D_{Fog2}-D_{Fog1})/D_{Fog1}\times 100(\%)$$

wherein $D_{Fog1}$ is a minimum density of the photothermographic material that has been subjected to development at a temperature of not less than 100° C. and $D_{Fog2}$ is a minimum density of the photothermographic material that has been subjected to the development and then further subjected to exposure to light at an illumination intensity of 300 lux and a temperature of 45° C. for 24 hours, and wherein the light-sensitive layer comprises a binder having a glass transition point of 70 to 105° C.

2. The photothermographic material of claim 1, wherein the light-sensitive layer of the photothermographic material that has been subjected to development at a temperature of not less than 100° C. exhibits a thermal transition point of 46 to 200° C.

3. The photothermographic material of claim 1, wherein the light-sensitive layer or a light-insensitive layer comprises a silver-saving agent.

4. The photothermographic material of claim 1, wherein said binder is a polymer compound represented by the following formula (V)

formula (V)

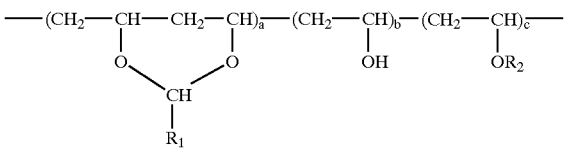

wherein $R_1$ is an alkyl group, or an aryl group; $R_2$ is an alkyl group, an aryl group, —$COR_3$ or —$CONHR_3$, in which $R_3$ is the same as defined in $R_1$; a is 40 to 86 mol %, b is 0 to 30 mol % and c is 0 to 60 mol %, provided that the sum of a, b and c is 100 mol %.

5. The photothermographic material of claim 3, wherein the silver-saving agent is a compound represented by the following formula (H):

formula (H)

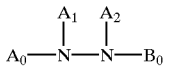

wherein $A_0$ is an aliphatic group, aromatic group, heterocyclic group, or -$G_0$-$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)-, —SO—, —$SO_2$— or —P(O)($G_1D_1$)- group, in which $G_1$ is a bond, or a —O—, —S— or —N($D_1$)- group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group.

6. The photothermographic material of claim 3, wherein the silver-saving agent is a compound represented by the following formula (G):

formula (G)

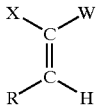

wherein X is an electron-withdrawing group; W is a hydrogen atom, an alkyl group, alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbmoyl group, a sulfonyl group, a sulfinyl group, an oxysulfinyl group, a thiosulfinyl group, a sulfamoyl group, an oxysulfamoyl group, a thiosulfamoyl group, a sulfinamoyl group, a phosphoryl group, nitro group, an imino group, a N-carbonylimino group, a N-sulfonylimino group, a dicyanoethylene group, an ammonium group, a sulfonium group, a phosphonium group, pyrylium group, or an inmonium group; R is a halogen atom, hydroxy, an alkoxy group, an aryloxy group, a heterocyclic-oxy group, an alkenyloxy group, an acyloxy group, an alkoxycarbonyloxy group, an aminocarbonyloxy group, a mercapto group, an alkylthio group, an arylthio group, a heterocyclic-thio group, an alkenylthio group, an acylthio group, an alkoxycarbonylthio group, an aminocarbonylthio group, an organic or inorganic salt of hydroxy or mercapto group, an amino group, a cyclic amino group, an acylamino group, an oxycarbonylamino group, a heterocyclic group, a ureido group, or a sulfonamido group, provided that X and W, or X and R may combine with each other to form a ring.

7. The photothermographic material of claim 3, wherein the silver-saving agent is a compound represented by the following formula (P):

formula (P)

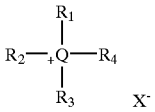

wherein Q is a nitrogen atom or a phosphorus atom; $R_1$, $R_2$, $R_3$ and $R_4$ each are a hydrogen atom, an alkyl group, an alkenyl group, an alkynyl group, an aryl group, a heterocyclic group or an amino group, provided that $R_1$, $R_2$, $R_3$ and $R_4$ may combine together with each other to form a ring; and $X^-$ is an anion.

8. The photothermographic material of claim 1, wherein the photothermographic material comprises at least two compounds selected from the group consisting of a compound generating a labile species capable of oxidizing silver upon exposure to a ultraviolet ray or visible light and a compound generating a labile species capable of deactivating the reducing agent to render impossible reduction of a silver ion of the organic silver salt to silver upon exposure to a ultraviolet ray or visible light.

9. The photothermographic material of claim 1, wherein the light-sensitive layer comprises at least two light-sensitive layers.

10. A photothermographic material comprising on a support a light-sensitive layer comprising an organic silver salt, light-sensitive silver halide grains, a reducing agent and a binder, wherein the photothermographic material exhibits not more than 30% of a rate of variation in fog density defined below:

$$\text{Rate of variation in fog density}=(D_{Fog2}-D_{Fog1})/DFog1\times100(\%)$$

wherein $D_{Fog1}$ is a minimum density of the photothermographic material that has been subjected to development at a temperature of not less than 100° C. and $D_{Fog2}$ is a minimum density of the photothermographic material that has been subjected to the development and then further subjected to exposure to light at an illumination intensity of 300 lux and a temperature of 45° C. for 24 hours, and wherein the light-sensitive layer comprises an organic gelling agent.

11. The photothermographic material of claim 10, wherein said organic gelling agent is a polyhydric alcohol.

12. The photothermographic material of claim 10, wherein said organic gelling agent is a compound represented by the following formula (1) or (2):

formula (1)

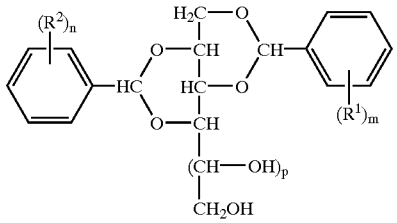

wherein $R_1$ and $R_2$ are each a hydrogen atom, an alkyl group having 1 to 4 carbon atoms, an alkoxy group having 1 to 4 carbon atoms o a halogen atom; m and n are each an integer of 1 to 5; p is 0 or 1, provided that when m is 2, two $R^1$s may combine with each other to form a tetralin ring together with an attached benzene ring attached to $R^1$, and that when n is 2, two $R^2$s may combine with each other to form a tetralin ring together with a benzene ring linked with them;
formula (2)
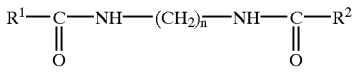
wherein $R^1$ and $R^2$ are each 12-hydroxyoctadecyl or 12-hydroxyoctadecenyl; and n is an integer of 2 to 12.
13. The photothermographic material of claim 1, wherein said binder is a polyvinyl acetal substantially having an acetoacetal structure.
* * * * *